US006375048B1

(12) United States Patent
van der Meer et al.

(10) Patent No.: US 6,375,048 B1
(45) Date of Patent: Apr. 23, 2002

(54) ASSEMBLY FOR STORING AND DISPENSING BEER AND OTHER CARBONATED BEVERAGES

(75) Inventors: Sietze van der Meer, Drachten; Sjoerd Timmermans, Den Haag, both of (NL)

(73) Assignee: Heineken Technical Services B.V., Amsterdam (NL)

( * ) Notice: Subject to any disclaimer, the term of this patent is extended or adjusted under 35 U.S.C. 154(b) by 0 days.

(21) Appl. No.: 09/486,937

(22) PCT Filed: Sep. 4, 1998

(86) PCT No.: PCT/NL98/00508

§ 371 Date: May 8, 2000

§ 102(e) Date: May 8, 2000

(87) PCT Pub. No.: WO99/11563

PCT Pub. Date: Mar. 11, 1999

Related U.S. Application Data

(60) Provisional application No. 60/057,616, filed on Sep. 4, 1997, and provisional application No. 60/057,814, filed on Sep. 4, 1997.

(30) Foreign Application Priority Data

Sep. 4, 1997 (NL) ..... 1006949
Sep. 4, 1997 (NL) ..... 1006950

(51) Int. Cl.[7] ..... B65D 82/00

(52) U.S. Cl. ..... 222/396; 222/95; 222/105; 222/389

(58) Field of Search ..... 222/88, 83, 83.5, 222/95, 103, 105, 146.6, 179.5, 183, 214, 335, 386.5, 389, 396

(56) References Cited

U.S. PATENT DOCUMENTS

| | | | | | |
|---|---|---|---|---|---|
| 4,119,112 | A | * | 10/1978 | Adler | 137/68 R |
| 4,120,425 | A | | 10/1978 | Bethurum | |
| 4,162,030 | A | * | 7/1979 | Capra | 222/321 |
| 4,562,942 | A | * | 1/1986 | Diamond | 222/386.5 |
| 4,921,135 | A | * | 5/1990 | Pleet | 222/82 |
| 5,199,609 | A | * | 4/1993 | Ash | 222/94 |
| 5,251,787 | A | * | 10/1993 | Simson | 222/95 |
| 5,303,852 | A | * | 4/1994 | Yamawaki et al. | 222/209 |
| 5,312,018 | A | * | 5/1994 | Evezich | 222/95 |

FOREIGN PATENT DOCUMENTS

| | | |
|---|---|---|
| EP | 0 377 195 | 7/1990 |
| EP | 0 389 191 | 9/1990 |
| FR | 1 324 104 | 7/1963 |
| GB | 2 146 705 | 4/1985 |
| GB | 2 152 019 | 7/1985 |
| NL | 1 007 084 | 12/1997 |
| WO | WO 92 12926 | 8/1992 |
| WO | WO 93 11059 | 6/1993 |

* cited by examiner

*Primary Examiner*—Henry C. Yuen
*Assistant Examiner*—Melvin A. Cartagena
(74) *Attorney, Agent, or Firm*—Pearne & Gordon LLP

(57) ABSTRACT

Wind turbine assembly consisting of a wind turbine mounted in a wing profile. The aim is to fix the wing profile to the ground surface with the aid of the cable and to allow such a wing profile to float through a combination of aerodynamic lift and lighter-than-air buoyancy at an appreciable height above the ground surface. As a result the maximum amount of wind can be caught. The wind turbine consists of a turbine having a horizontal shaft, the blades being constructed as flexible webs which change in shape depending on the rotational position thereof.

55 Claims, 20 Drawing Sheets

ASSEMBLY FOR STORING AND DISPENSING BEER AND OTHER CARBONATED BEVERAGES

This application claims the benefit of U.S. Provisional Application Ser. Nos. 60/057,616, filed Sep. 4, 1997, and 60/057,814, filed Sep. 4, 1997.

The invention relates to an assembly according to the preamble of claim 1. Such assembly is known from European patent application 0 377 195.

This known assembly comprises a pressure vessel and a container which can be accommodated therein and which can be compressed by feeding, under pressure, a pressure medium such as air or water into the pressure vessel. By means of a closing screw thread connection, the container is connected to a dispensing line accommodated in a cover part of the pressure vessel. The pressure vessel consists of a box-shaped bottom part and the above-mentioned cover part, which is removable from the bottom part. When this assembly is used, the container is screwed into the removed cover part and subsequently slid into the bottom part, after which the cover part is fixed onto the bottom part. As a result, a closed pressure chamber is created around the entire container. Provided in the dispensing line is a tap by means of which the dispensing line can be opened and closed. When the tap is opened, the beverage can be forced out of the container through the dispensing channel and to the environment, by compressing the container. This known assembly readily enables beverage to be discharged from a compressible container.

A drawback of this known assembly is that pressure can be built up in the pressure vessel while no container has been placed in the pressure vessel. Energetically and in terms of safety, this is undesirable. Moreover, before being placed in the pressure vessel, the container should first be screwed into the loose cover part, while moreover, the container should first be opened. Only then can the container be inserted into the pressure vessel and can the pressure chamber be closed. This means that during placement of the container in the pressure vessel, beverage could already flow away to the environment. Moreover, the cover part should be separated completely from the bottom part. This means that particular constructional measures must be taken to be able to withstand the pressure required for compressing the container. A further drawback of this known assembly is that the container in the pressure vessel is retained adjacent the neck only, which results in a relatively unstable positioning of the bottle.

It is an object of the invention to provide an assembly in which the drawbacks mentioned are avoided while the advantages thereof are maintained. To that end, an assembly according to the invention is characterized by the features set forth herein.

Because the pressure space, during use, is at least partly determined and closed from the environment by a closing part which is to be placed together with the container, the advantage is obtained that pressure can be built up in the pressure vessel only when the container has been positioned in the proper manner. After all, pressure medium fed into the dispensing device could otherwise directly flow away again therefrom. This means that if the device is switched on unintentionally, the absence of a container will quickly be observed, while, moreover, the risk of opening a pressurized device without container, which might cause danger to a user, is eliminated. And precisely when a container is absent, a user will be inclined to handle the assembly less carefully. As a result, an assembly according to the invention is considerably safer than the known assembly. Because the closing part is arranged at a distance from the dispensing opening of the container, the closing pressure is provided over a relatively large surface area, so that a proper sealing can be obtained, while the sealing can take up relatively large tolerances. Since the dispensing opening is located outside the pressure vessel, the pressure medium in the pressure chamber is readily prevented from contacting the beverage to be dispensed. Thus, the quality of the beverage is maintained throughout the duration of its use. A further advantage of an assembly according to the invention is that the container can first be placed in the bottom part, after which the cover part can be closed over the container while the container, at least the dispensing opening, need only be opened, if desired, after its placement in the device. Indeed, the dispensing opening of the container is still accessible after placement of the container in the pressure vessel and formation of the pressure chamber. This means that the container, during placement thereof in the pressure vessel, can remain closed, if this is desired. This readily prevents the beverage from flowing away unintentionally.

In an advantageous embodiment a collar-shaped closing part extending around the container at a distance from the filling and/or dispensing opening, offers the advantage that the positioning of the container in the pressure vessel is simplified even further. After all, the part of the container which, during use, extends inside the pressure chamber can easily pass an insertion opening, while the collar-shaped part can strike, in at least one direction, closing means cooperating therewith, while the container may have a substantially cylindrical outer wall, which is advantageous from a productional and aesthetic viewpoint. Accordingly, a proper sealing can be realized in a simple manner, in cooperation with at least a portion of the longitudinal edge mentioned. Moreover, a correct positioning of the container in the pressure vessel is directly obtained thereby.

In a further advantageous embodiment, an assembly according to the invention is further characterized by the features of claim 6.

In a further advantageous embodiment, a substantially undeformable container, in which a storage compartment for the beverage is included, can be used. A deformable part separates the storage compartment from the pressure chamber. Particularly outside the tapping device, such container offers the advantage that the storage compartment is well-protected, while during use, it can nevertheless be emptied in a simple manner by means of the pressure medium. Such container is particularly suitable as beverage container for repeated use.

In a further preferred embodiment, the container is compressible by means of the pressure medium which is fed, under pressure, into the pressure chamber. The fit-on part, which, under the influence of the pressure of the pressure medium, is at least sufficiently undeformable, provides a permanent closure of the pressure chamber. This means that the container can readily be compressed, preferably completely. Such container is eminently suitable as disposable container. In a particularly advantageous embodiment, the container can be completely compressed in the fit-on part. In that case, the container is preferably manufactured from plastic, in particular a polymer, preferably a thermoplastic polymer, so as to be thin-walled and self-supporting. In particular PET or, in a preferred embodiment, PEN are plastics suitable for use for a beverage container according to the invention, particularly since these plastics are properly processable, for instance by injection-molding and blowing. In different applications, in particular when low oxygen- and $CO_2$-permeability is desired, a PET/PEN laminate or blend is particularly suitable. Such plastic container can be deformed relatively easily and offers adequate protection to the beverage prior to and during use. In this regard, in particular a relatively large container manufactured from PEN provides a suitable barrier to the passage of oxygen, which is for particular importance especially when a container is used for storing beer.

In a further preferred embodiment, a tubular dispensing means which is relatively fixedly connected to the container, offers the advantage that during use, the beverage to be dispensed from the container does not contact fixed parts of the tapping device. The tubular dispensing means is supplied as well as removed again together with the container. This renders a hygienic usage of such assembly particularly simple. Moreover, this considerably decreases the possibility of contact between the user and the beverage in the container to be dispensed. During use, the tapping device remains clean, so that no complex, costly and environmentally polluting cleaning operations are required prior to a renewed use of the tapping device.

In a further preferred embodiment, an at least partially flexible, hose-shaped dispensing means offers the advantage that for closing the dispensing channel, it can easily be pressed shut. To that end, a pressure means may for instance be provided in the tapping device, which pressure means, together with the dispensing means, forms a hose tap.

In a preferred embodiment, an engagement means offers the advantage that the free end of the dispensing means can readily be engaged and moved to a position outside the dispensing device, for instance for insertion into a hose tap. Moreover, this engagement means can, during use of the tapping device, be visible from the outside thereof and for instance be used for indicating the contents of the container. Thus, the contents of the container are directly clear to the user. When the dispensing means is fixedly connected to the container, it is assured that the indication on the engagement means corresponds to the contents of the container. Moreover, in this manner, the engagement means can perform an advertising function, for instance, branding, dating, logo, and the like.

Such engagement means offers the advantage that the free end of the dispensing means can readily be engaged and moved to a position outside the dispensing device, for instance for insertion into a hose tap. Moreover, this engagement means can, during use of the tapping device, be visible from the outside thereof and for instance be used for indicating the contents of the container. Thus, the contents of the container are directly clear to the user. When the dispensing means is fixedly connected to the container, it is assured that the indication on the engagement means corresponds to the contents of the container. Moreover, in this manner, the engagement means can perform an advertising function, for instance, branding, dating, logo, and the like.

In a particularly advantageous embodiment, pierceable tampering seal means offer the advantage that the container remains closed prior to and during its placement in the tapping device, as a result of which the contents of the container are guaranteed against manipulation or quality reduction. In this manner, the tampering seal means for instance prevent the contents of the container from contacting the environment prior to the use of the tapping device. A further advantage of such means is that the container can thus be filled aseptically, which renders pasteurization of the beverage in the container superfluous. In particular for containers having a relatively large content, this is particularly advantageous.

In a particularly advantageous manner, piercing of the tampering seal means is effected in the following manner. When pressure is built up in the pressure chamber, the container is moved axially in the direction of the closing means, with piercing means being forced through the tampering seal means. This creates a free communication between the inside of the container and the dispensing means. In that case, an automatic opening of the container is not obtained any sooner than when the tapping device, at least the pressure means thereof, is switched on.

In such embodiment, when pressure is built up in the pressure chamber, the container is moved axially in the direction of the closing means, with piercing means being forced through the tampering seal means. This creates a free communication between the inside of the container and the dispensing means. In that case, an automatic opening of the container is not obtained any sooner than when the tapping device, at least the pressure means thereof, is switched on.

The invention further relates to a method for tapping a beverage, in particular a carbonated beverage such as beer or carbonated soft drinks. With such method, a beverage can be dispensed from a container in a particularly safe and simple manner, which container can be purchased, stored and disposed of or reused separately from the device to be used for the method. Due to the configuration of the parts to be used for the method, relatively great tolerances can be taken up, while the use and operation require relatively little force and energy. Different types of containers with different contents can be emptied in the same tapping device, in the same or a comparable manner. Moreover, in such method, the container can be placed in closed condition in the pressure vessel and opened after that, which adds to the hygiene of such method.

In a first advantageous embodiment, a method according to the invention is characterized in that a compressible beverage container is used.

The compressible container has the advantage that it is relatively inexpensive in terms of purchase and use, that it can be of a relatively light design and, in empty condition, has a relatively small volume. Moreover, such container has the advantage of being self-supporting in filled condition, so that transportation and storage thereof are possible without expensive and complex exterior packagings.

In an alternative embodiment, a method according to the invention is characterized by use of a relatively rigid beverage container having a beverage storage compartment defined by a flexible membrane means. The rigid container is open to the pressure chamber while the storage compartment is separated from the rigid container walls and the pressure chamber by the membrane means. Such a relatively rigid container offers the advantage that it can be reused, while it can nevertheless be pressure-emptied in a tapping device according to the invention. Reuse of a container may offer environmental advantages. Moreover, such relatively rigid container has the advantage of being better resistant to external influence, for instance impact and shock loads, that the compressible container described earlier.

Moreover, the invention relates to an alternative embodiment of an assembly for storing and dispensing beverages. A known storage and dispensing assembly comprises a vessel, a so-called barrel, in which a quantity of beverages is stored under some excess pressure. The device further comprises a cylinder filled with a propellant, in particular carbon dioxide ($CO_2$). The vessel comprises connecting means through which, on the one hand, propellant can be introduced into the vessel and, on the other, the beverage can be dispensed via appropriate dispensing means, in particular a tapping device. The beverage is forced out of the vessel by the propellant which is introduced into the vessel under pressure.

Such known tapping assembly has the advantage that it has a simple construction and is simple to operate, while the dispensing pressure of the beer is controllable via the pressure of the propellant. However, the drawback of this known assembly is that blending of the propellant and the beverage in the vessel occurs. This means that the condition of the beverage in the vessel is affected and does not always remain constant. The degree to which the beverage is affected moreover substantially depends on, for instance, the pressure and nature of the propellant, the time in which the vessel is emptied and the accuracy with which the pressure of the propellant is set. Further, the user is limited in the choice of the propellant to be used, in view of its unavoidable contact with the beverage.

The object of the invention is to provide an assembly in which the drawbacks mentioned are avoided while the advantages thereof are maintained. To that end, an assembly according to the invention is characterized in that a beverage container has separating means to separate a storage compartment and a pressure chamber thereof. In this embodiment, dispensing means for dispensing the beverage are compatible to the storage compartment of the beverage container, and a pressure source is connectable to the pressure chamber of the container. The separation of the container into a storage compartment for the beverage and a pressure chamber offers the advantage that the beverage and the pressure medium are not brought into contact with each other. The separating means separating the pressure chamber from the storage compartment are arranged so that deformation thereof is possible under the influence of the beverage and the pressure medium. This implies that when the dispensing means are opened and excess pressure is built up in the pressure chamber, the beverage is forced out of the storage compartment by the separating means, while the composition and quality of the beverage remain constant. In particular in the case of carbonated beverages such as beer, this is of particular importance, because this causes the foam action of the beverage to remain constant, which is particularly important in terms of taste but also visually. Moreover, this prevents the dispensing of the beverage from being adversely affected or even made impossible because of incorrect foaming.

Because the separating means move and/or deform in the container, the container can have a rigid outer shape if necessary, and maintain the same shape throughout the duration of its use. Hence, such container can be constructed as a refillable container.

A further advantage of an assembly according to the invention is that a great freedom in the choice of the pressure source to be used is obtained. For instance, a pressure source can advantageously be employed in which a fluid such as a gas or a liquid can be introduced into the pressure chamber. The pressure source can for instance comprise a pressure cylinder for a propellant such as carbon dioxide ($CO_2$), but can also be constructed with a pressure pump, for instance for feeding a liquid such as water into the pressure chamber.

In a preferred embodiment, the separating means comprise a membrane.

The membrane offers the advantage that by means of deformation, it can effect a change of volume of the compartments. For this, the membrane can be completely deformed against the inner wall of the container, for a minimal or maximal volume. The membrane is preferably slightly sheet-shaped, as a result of which they occupy little space.

During the dispensing of beverage by increasing the pressure in and the volume of the pressure chamber, at least a portion of the membrane moves in the direction of the dispensing means. By causing an elastic deformation in the membrane at least during a portion of this displacement, the advantage is achieved that the membrane, at least when the storage compartment is substantially empty, will be stretched substantially taut, or will at least be smooth. This prevents the possible enclosure of beverage between the membrane and for instance the wall of the container, which beverage can no longer be forced in the direction of the dispensing means because of the excess pressure in the pressure chamber. In this respect, it is particularly advantageous if the dispensing means are positioned so that upon deformation of the membrane, a central portion of the membrane is moved to a position adjacent, or preferably moved against, at least opposite the dispensing means, while, during use, deformations in the membrane become larger towards the edges.

Separating means comprising or designed as piston means may be of simple and relatively rigid or slightly deformable design, while the piston means may be arranged for movement in the longitudinal direction of the container. Displacement of such piston means can be effected in a manner described hereinabove by feeding a pressure medium into the pressure chamber, but may also be effected in a mechanical or mechano-electric manner, for instance by means of pushing or pulling means such as a screw spindle, electromagnetic means or the like. Piston means may be of a simple, robust design, which may provide a long service life of the device in question.

In an alternative further embodiment, an assembly according to the invention is further characterized in that the pressure source and tapping means are part of a tapping device adapted to receive a beverage container as above described. Positioning at least one opening for connecting the pressure source to the container at a distance from the bottom thereof, preferably relatively high in the annular wall, offers the advantage that containers of different heights can always be accommodated in the same tapping device, without the height of the dispensing opening having to vary relative to that device. As it is, the distance between the dispensing opening and at least one connecting opening can in each case be chosen to be equal for different containers, as well as the diameter thereof, while the height can be varied.

In a further preferred embodiment, an assembly according to the invention is further characterized by a cap which is fixedly connected to the rest of the container, such that it cannot be detached without damage. Therefor, it can always be established whether the cap has been separated from the rest of the container. Because at least a portion of the dispensing means, at least connecting means therefor, are confined within the container under the cap, and can only be approached by breaking the tampering seal means, the contents of the container cannot be reached without this being visible on the outside of the container, in particular the outside of the cap. Moreover, the dispensing means, confined under the cap prior to use, are adequately protected against damages and foulings, and the contents of the container cannot be contaminated or otherwise affected.

In a further elaboration, an assembly according to the invention has an at least partially flexible tube which is permanently connected to the beverage container, and which is connected to the tapping means. The at least partially flexible tube part can readily be stored under the cap, for instance above the storage compartment, and, at the start of the use, be pulled partially outside the cap, via the opening in the cap. For that purpose, one need merely remove the cover from the opening. If necessary, the tube part may be connected to the cover part, such that when the cover part is being removed, a free end of the tube part is directly carried along to a position outside the cap, for connection to suitable tapping means. In this regard, the cover part may be provided with a print, for instance a logo or an indication of the contents of the container. Accordingly, when the tube part is coupled to those tapping means, the advantage achieved is that in each case, it is and remains clear what are the contents of the container in question. Moreover, the broken-off cover part performs an advertising function. In fact, an engaging means having a comparable function may also be attached to the tube part in a different manner, which is entirely retained under the cap and is freely removable.

The invention further relates to a method of dispensing a beverage, in particular beer, preferably by means of an assembly according to the invention. Such method provides the possibility of dispensing beverage of a constant quality from a container in a simple and economical manner, while different pressure mediums can be used.

The invention further relates to a container suitable for use in an assembly or method according to the invention.

Further advantageous embodiments of an assembly, method, tapping device and container according to the invention are described in the subclaims and will hereinafter be specified with reference to the accompanying drawings. In these drawings:

Figure 6:
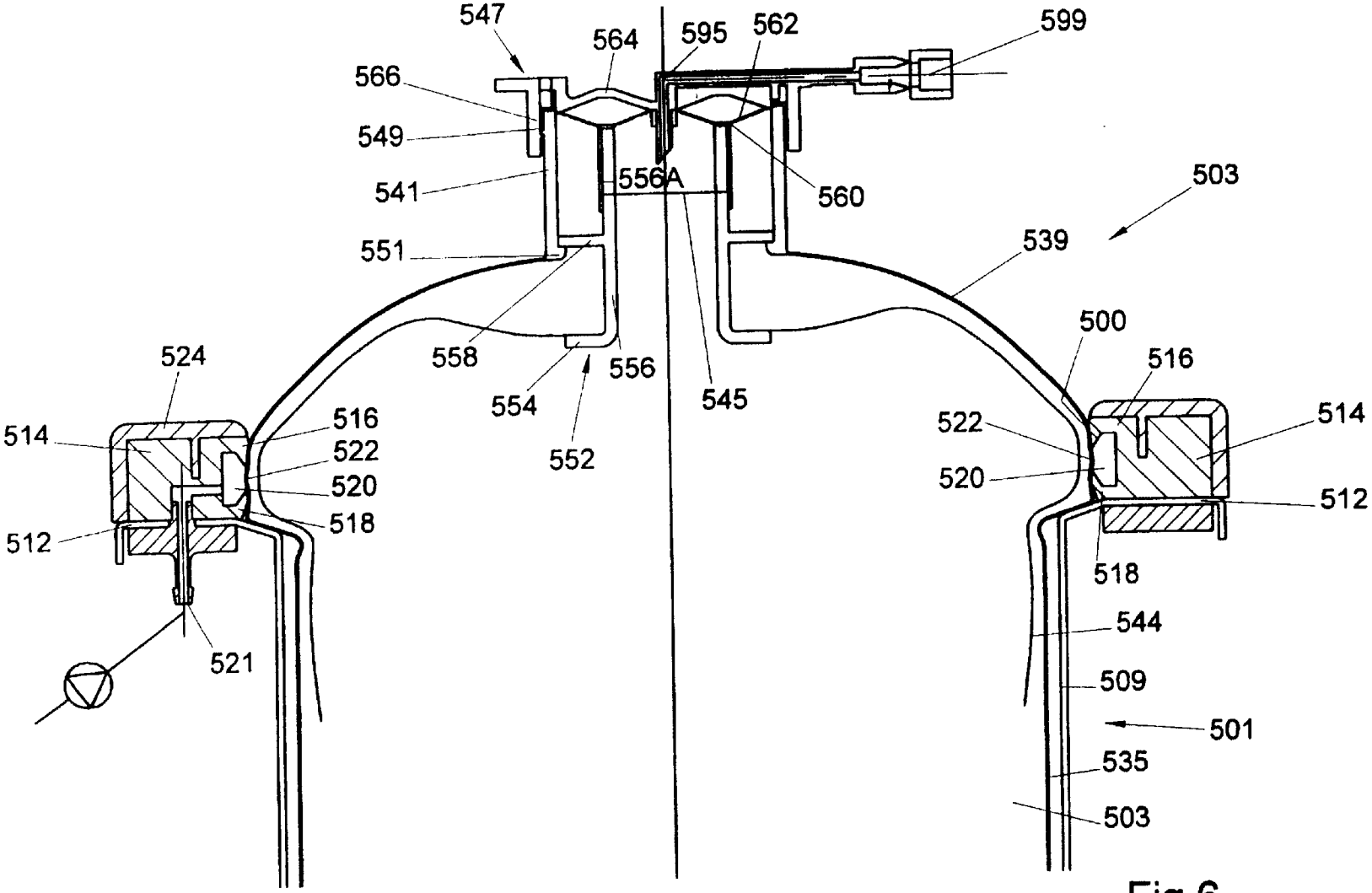
Figure 7:
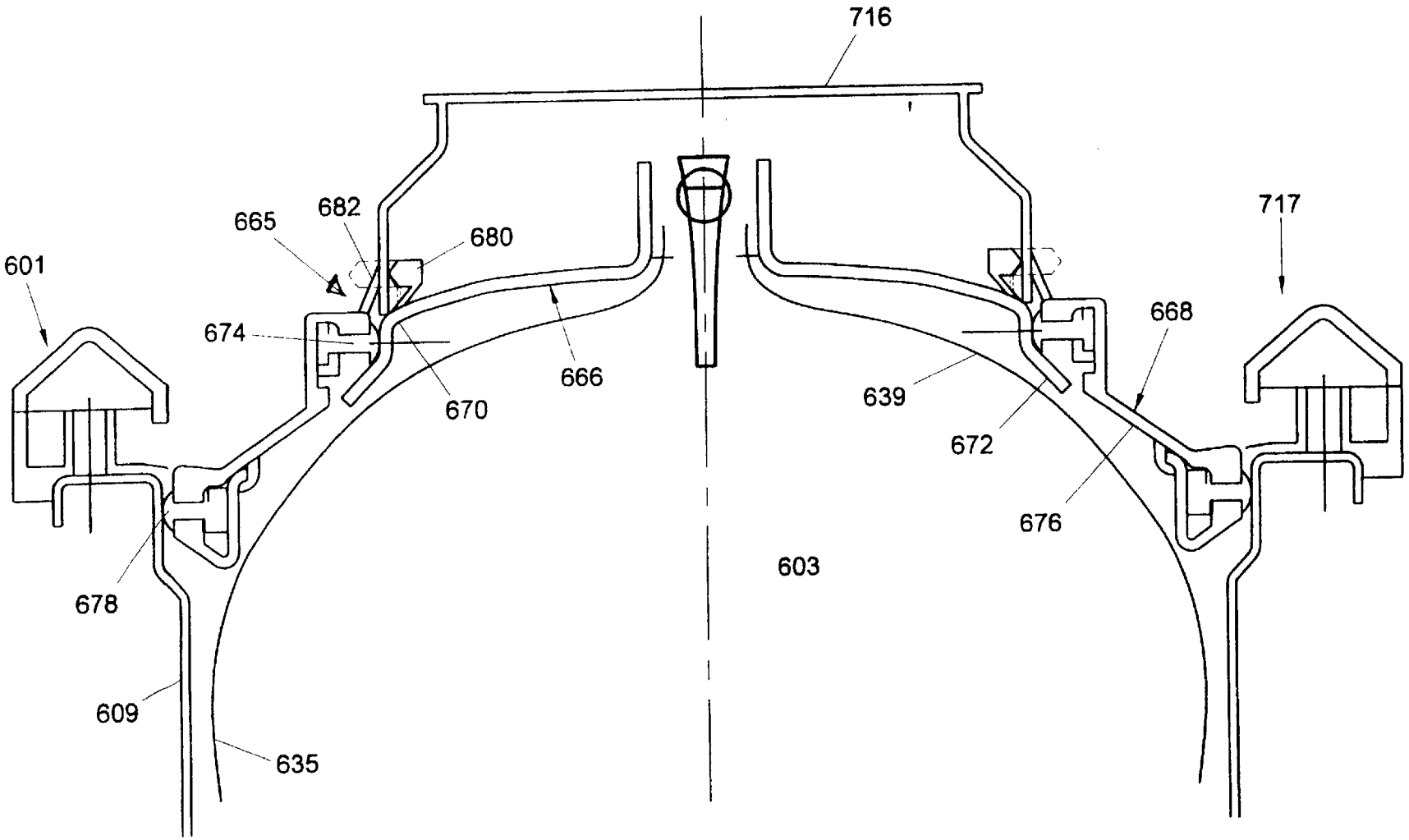

FIG. 6 is a diagrammatic, sectional side elevation of the top part of an alternative embodiment of a beverage container together with, diagrammatically, a relevant part of the tapping device; and FIG. 7 is a diagrammatic, sectional side elevation of a top part of a further alternative embodiment of a beverage container according to the invention, together with the relevant part of the tapping device.

Figure 8:
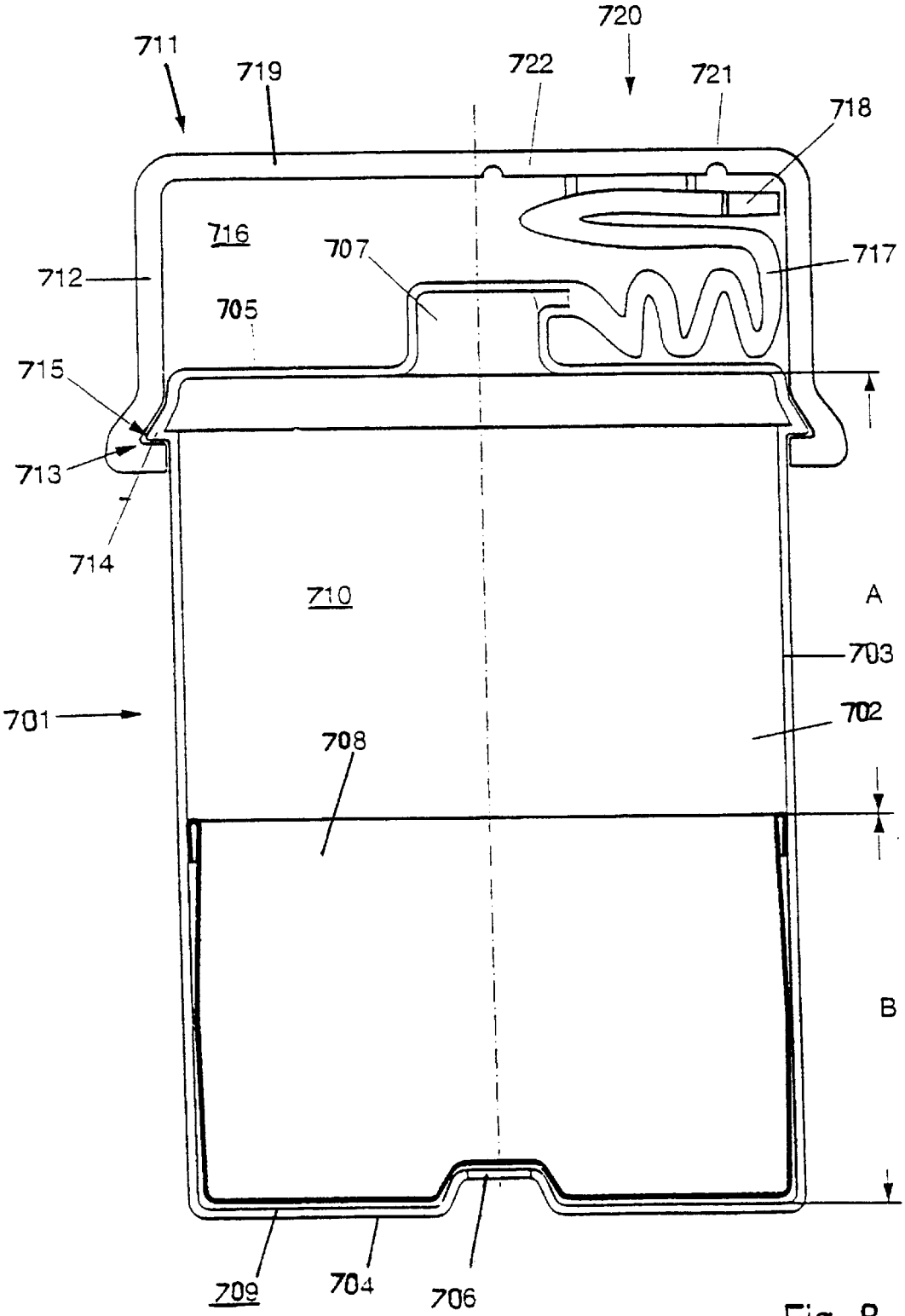
Figure 9:
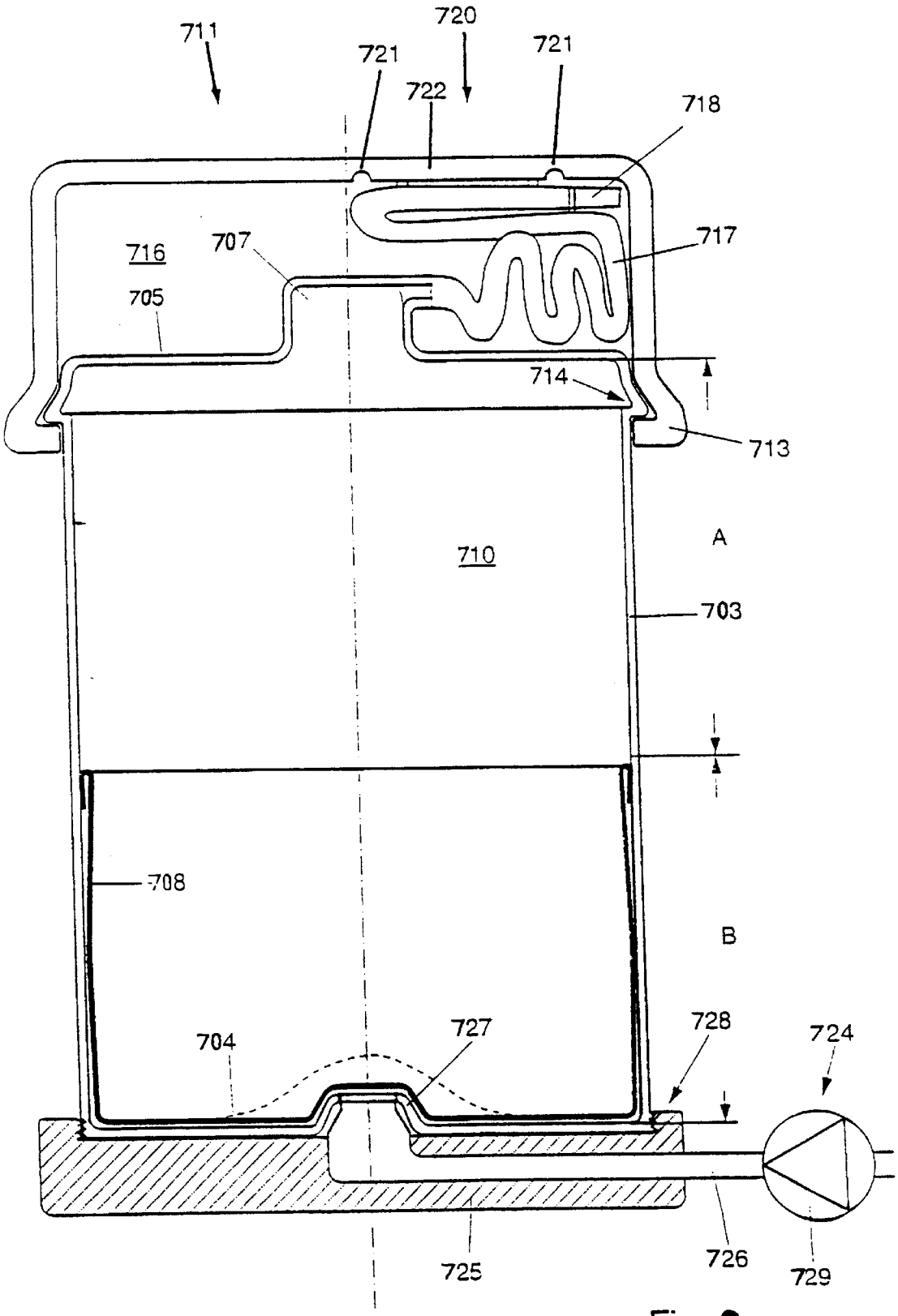
Figure 9A:
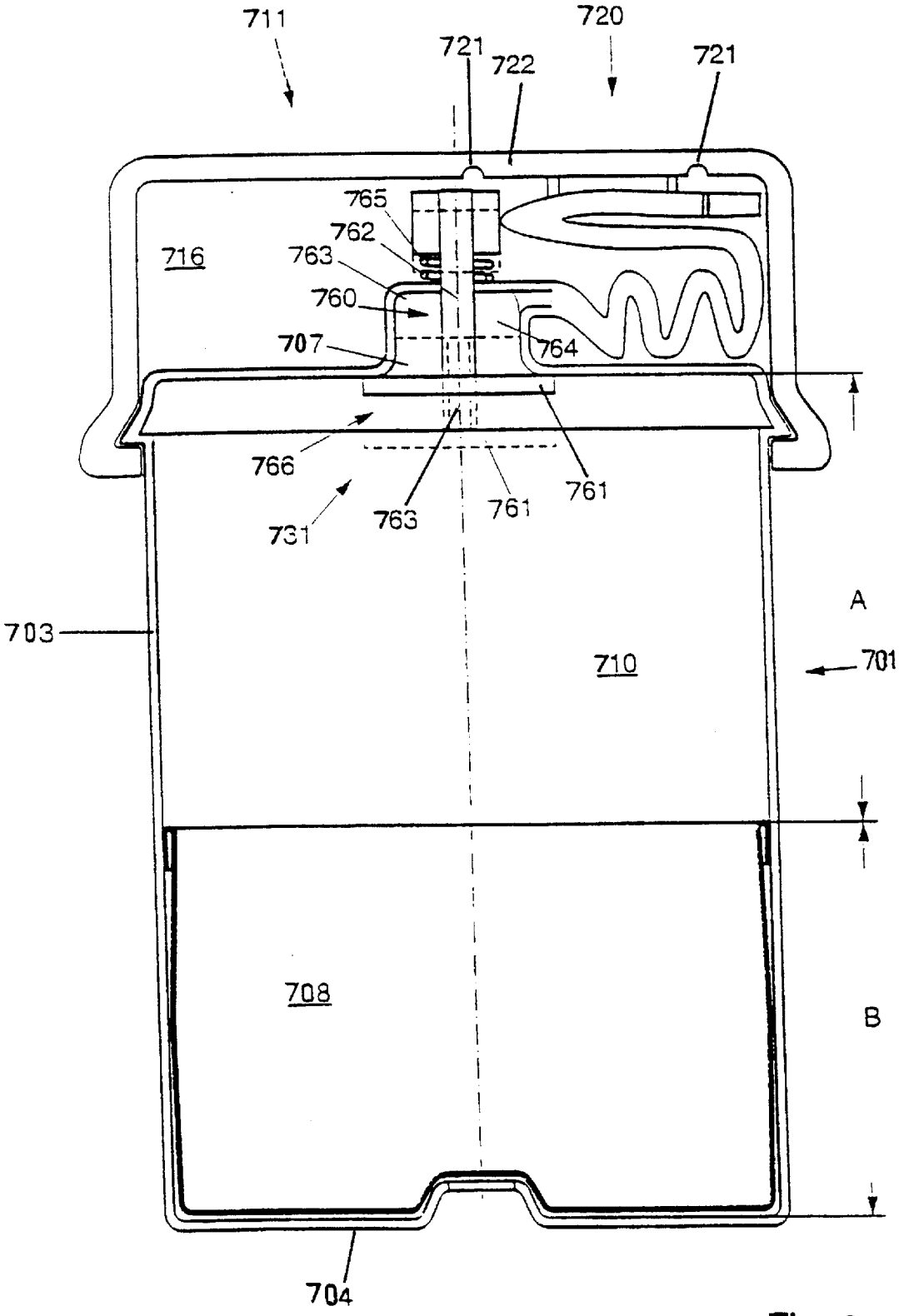
Figure 9B:
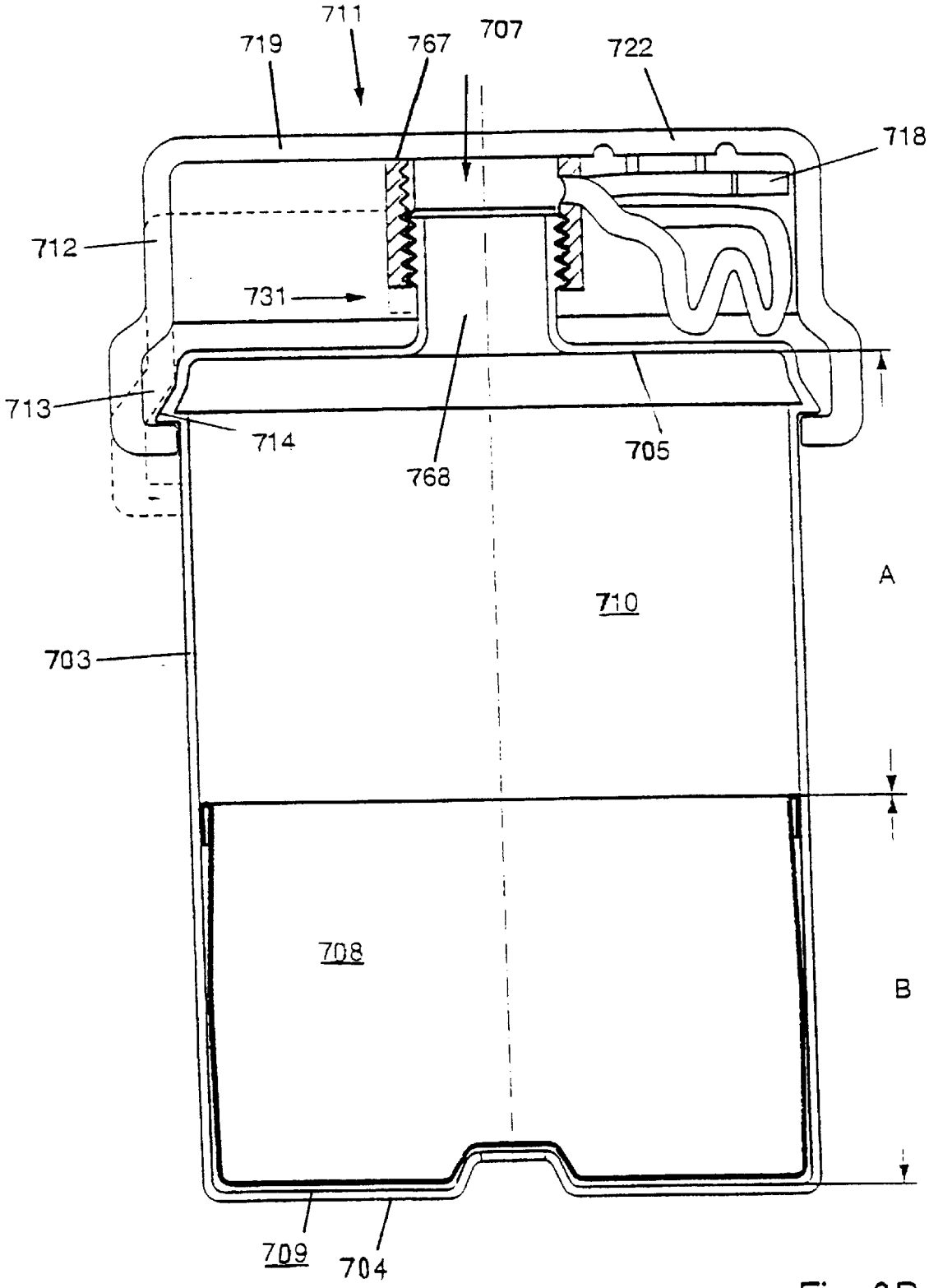
Figure 9C:
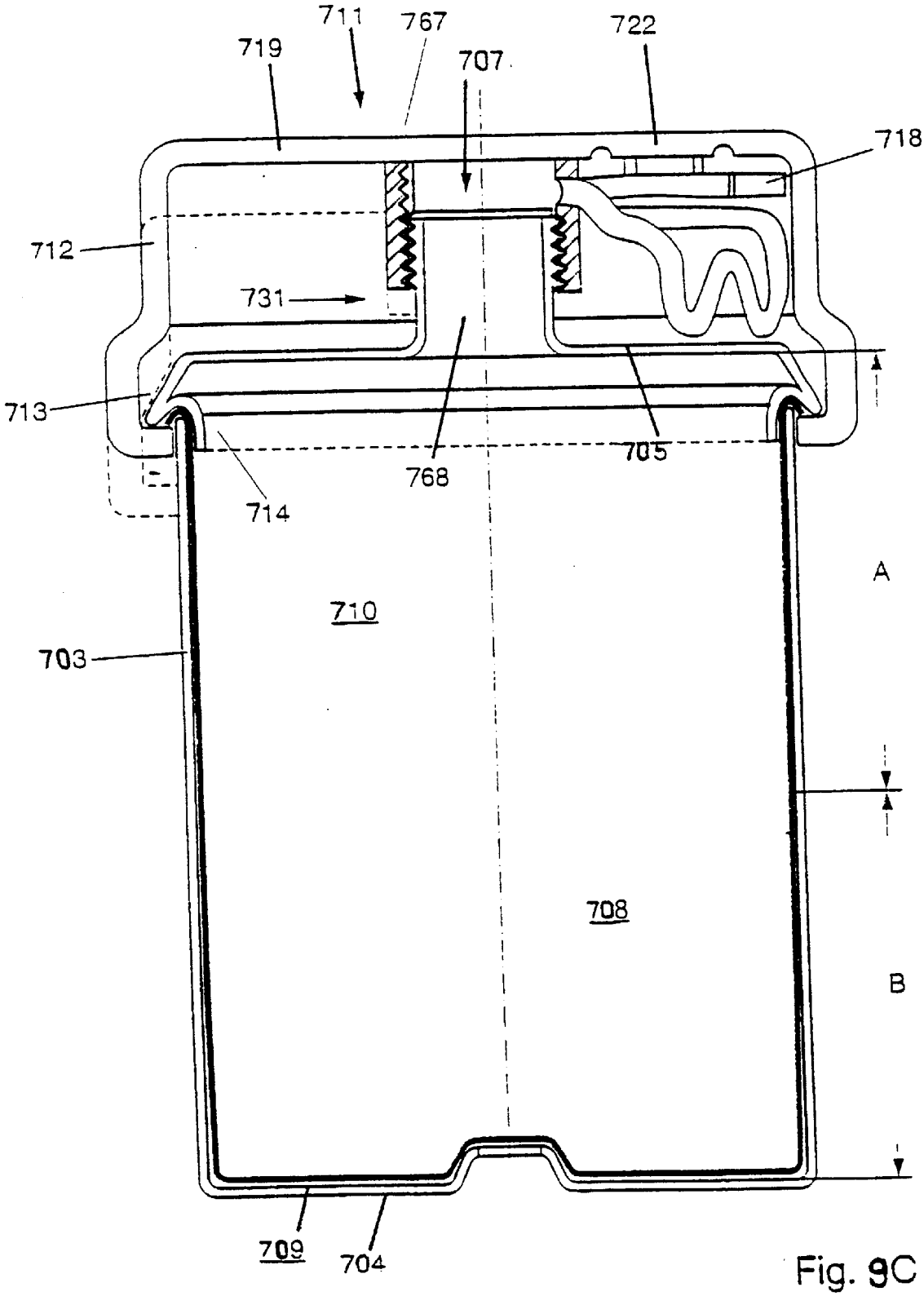
Figure 10:
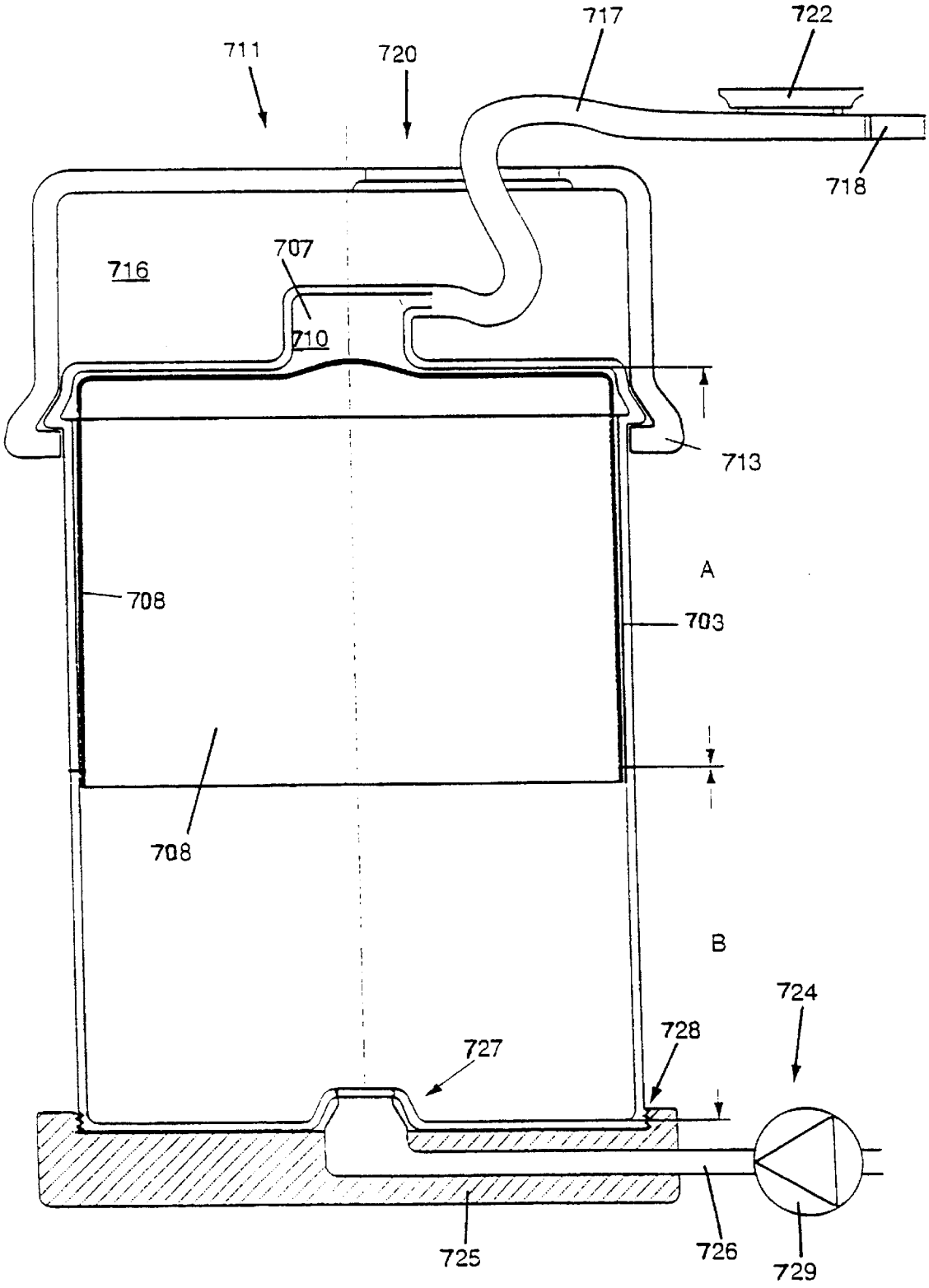
Figure 10A:
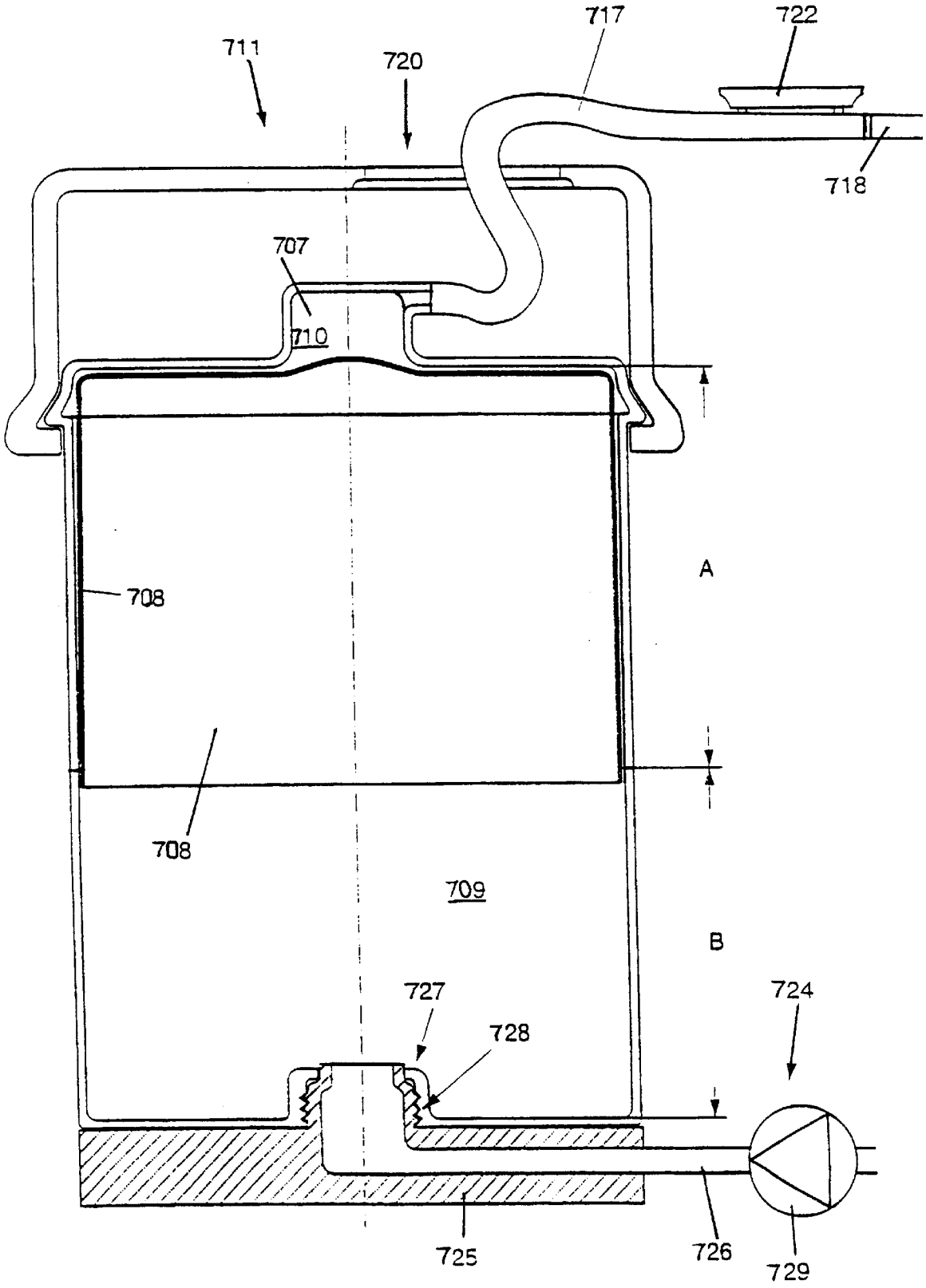
Figure 11:
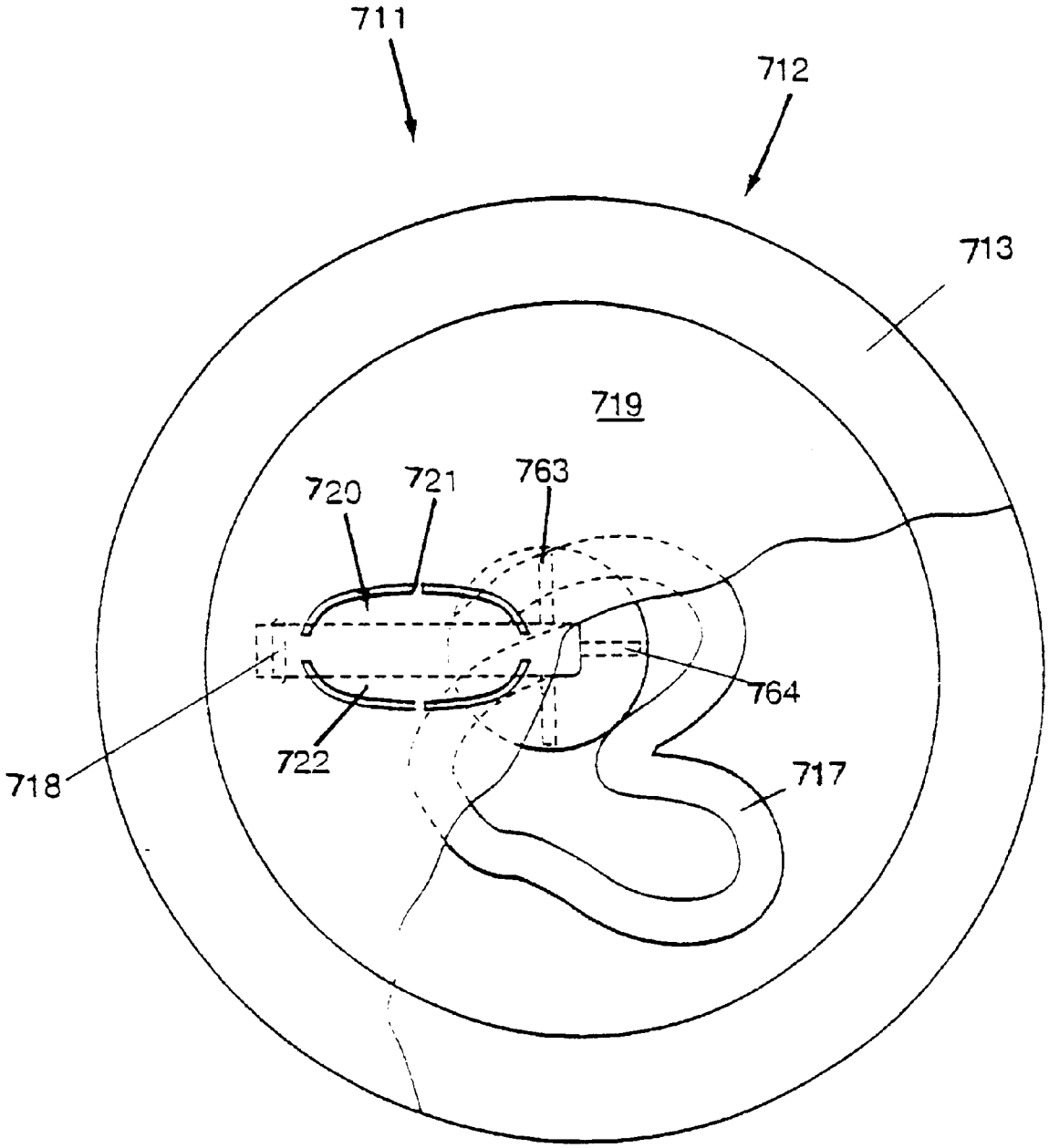
Figure 12:
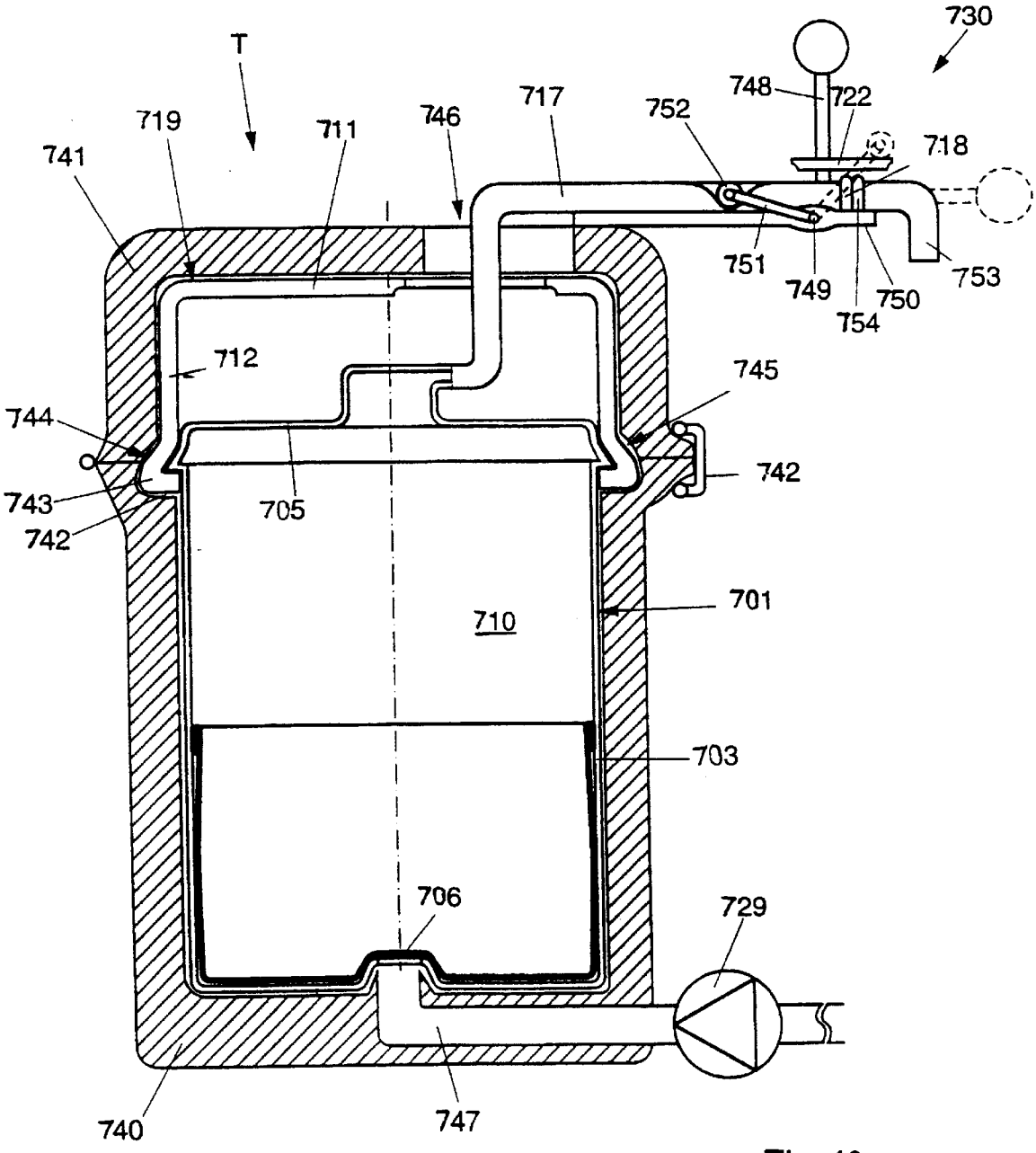
Figure 13:
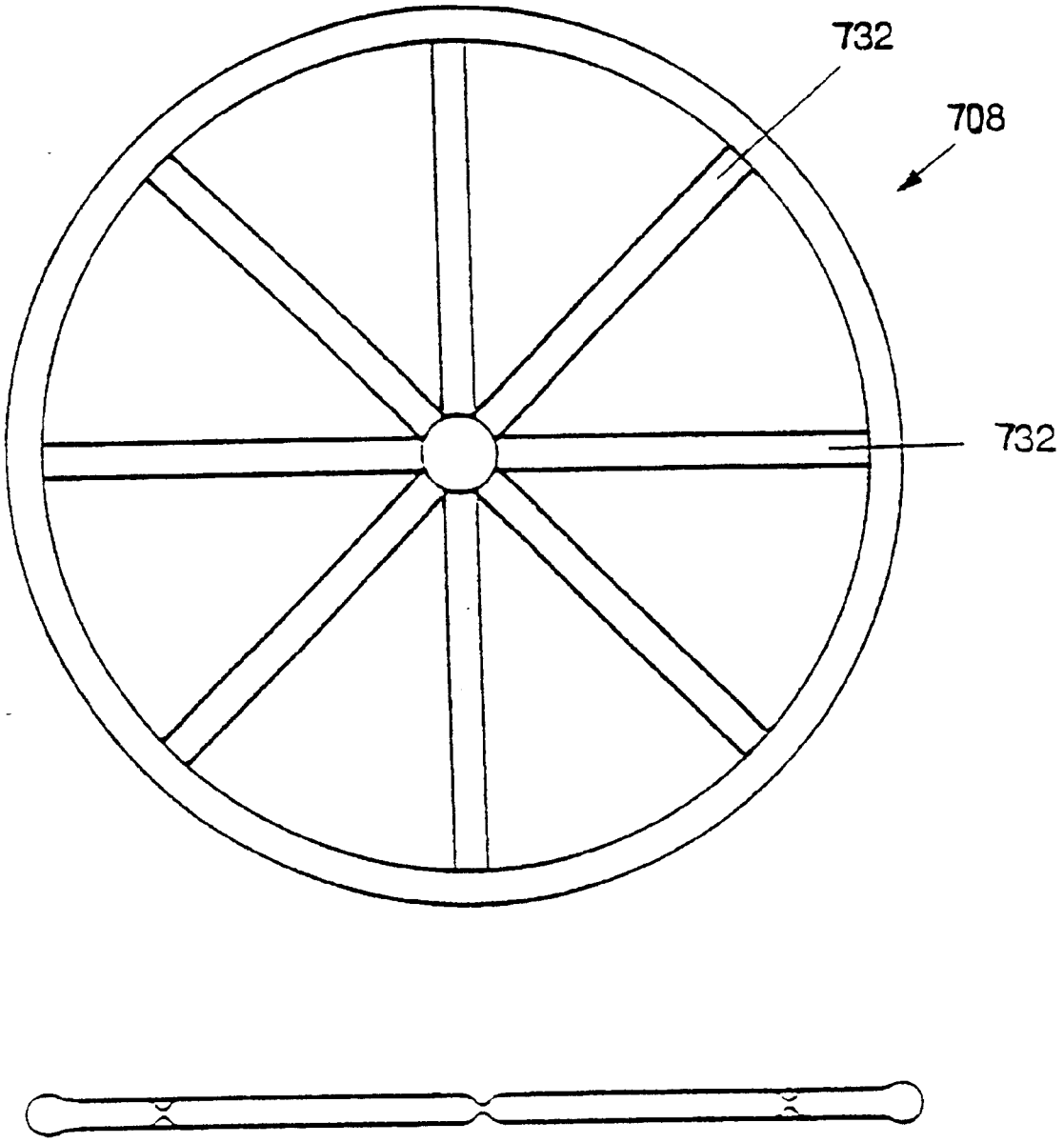
Figure 14:
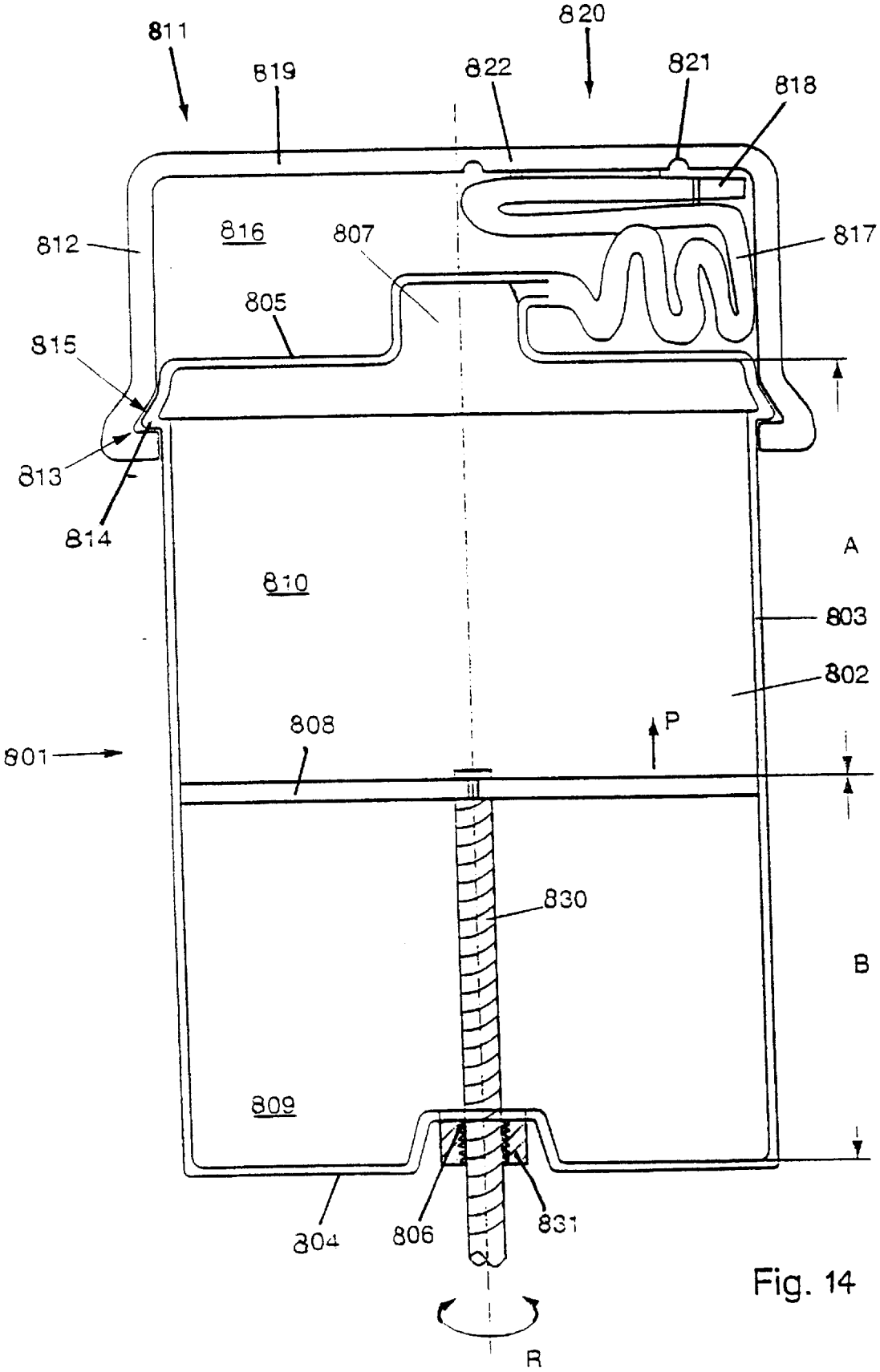
Figure 15:
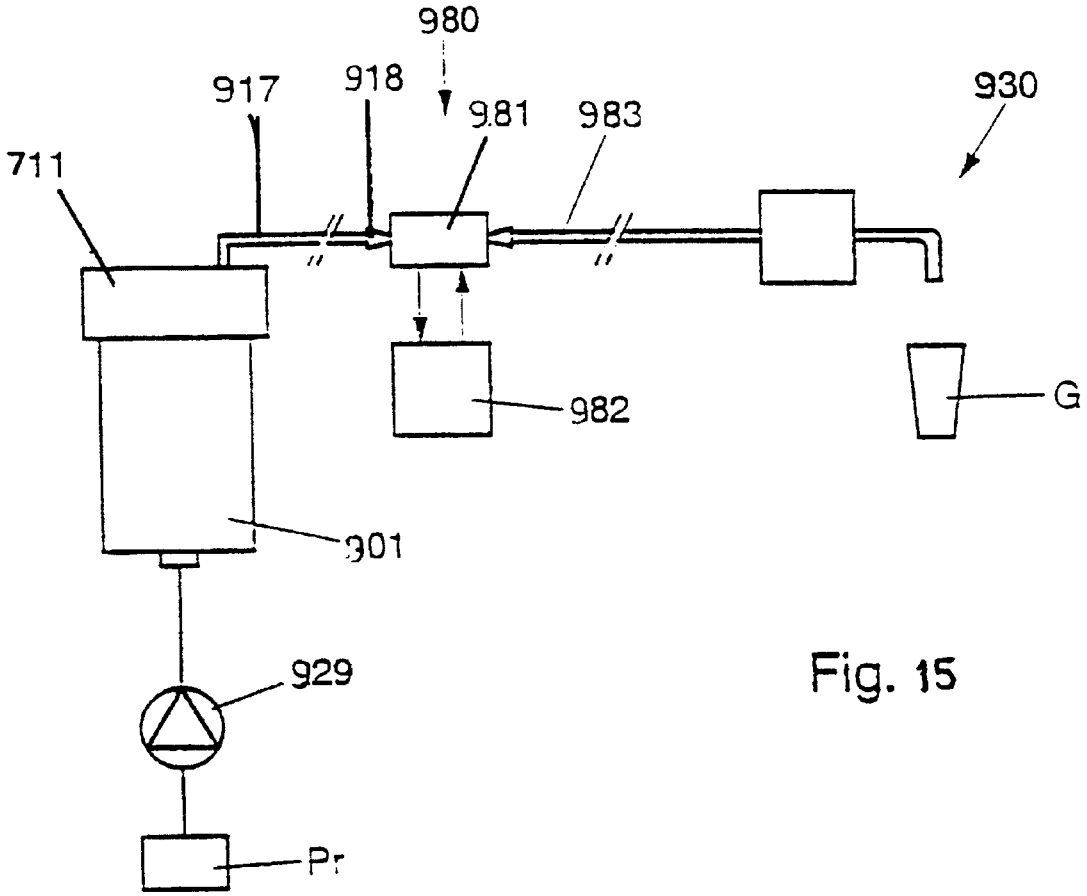
Figure 16:
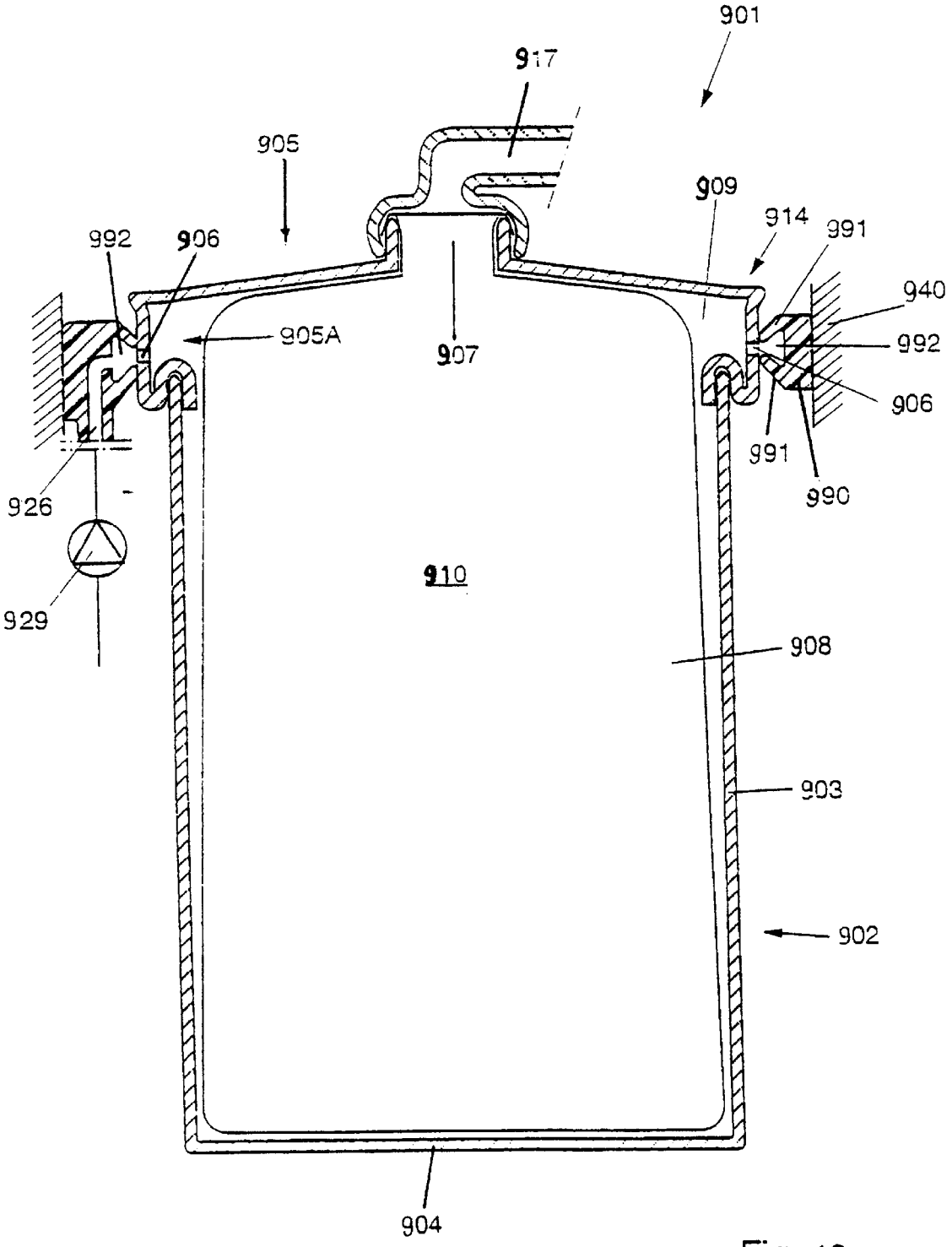
Figure 16A:
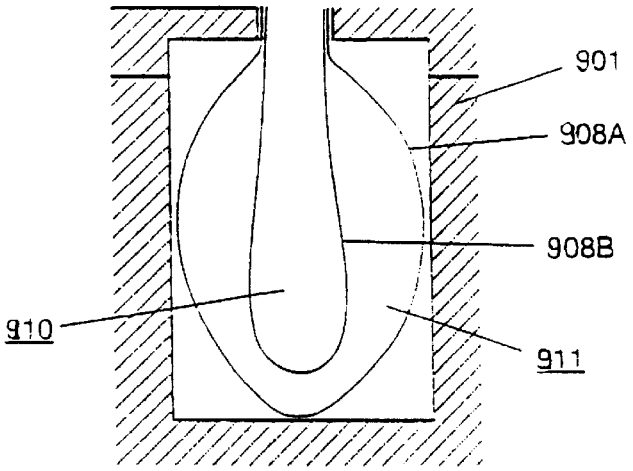
Figure 16B:
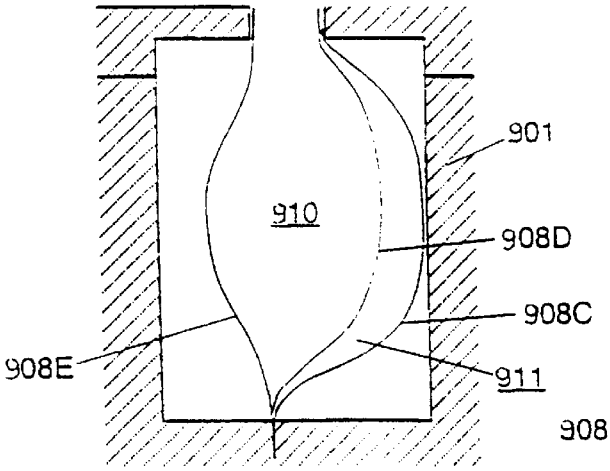
Figure 16C:
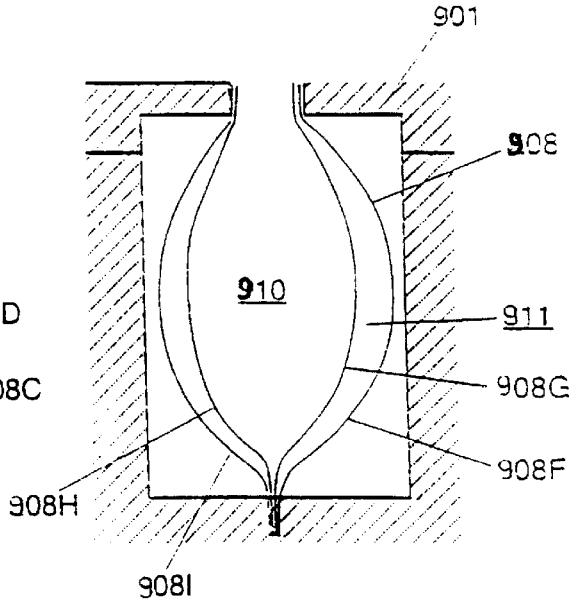

FIG. 8 is a sectional side elevation of a container, in a beverage-filled condition, prior to use;

FIG. 9 diagrammatically shows a device according to the invention, ready for being connected to a tapping device;

FIG. 9A shows a closing device for use with a container according to the invention;

FIG. 9B shows an alternative embodiment of closing means for a container according to the invention;

FIG. 9C shows an alternative embodiment of a device according to FIG. 9, in which the membrane is fixed under a cover edge;

FIG. 10 is a sectional side elevation of a container according to FIG. 8, in emptied condition, with an alternative coupling for the container to the pressure source, located on the outside;

FIG. 10A shows the device according to FIG. 10, with the coupling between container and pressure source located on the inside;

FIG. 11 is a top plan view of a container according to the invention, with the cap partially broken away;

FIG. 12 shows an alternative embodiment of a device according to the invention;

FIG. 13 is a top plan view of a membrane for a container according to the invention, in an alternative embodiment;

FIG. 14 is a sectional side elevation of a container according to the invention in a second alternative embodiment;

FIG. 15 shows a device according to the invention in a further alternative embodiment;

FIG. 16 is a sectional side elevation of a container according to the invention in a third alternative embodiment, showing diagrammatically a portion of a tapping device for receiving the container; and FIGS. 16A–C diagrammatically show three exemplary embodiments of a double-walled foil bag for use in an assembly according to FIG. 16.

In the FIGS. 1–7, corresponding parts have corresponding reference numerals, whereas in FIGS. 8–16C corresponding parts also have corresponding reference numerals.

Figure 1:
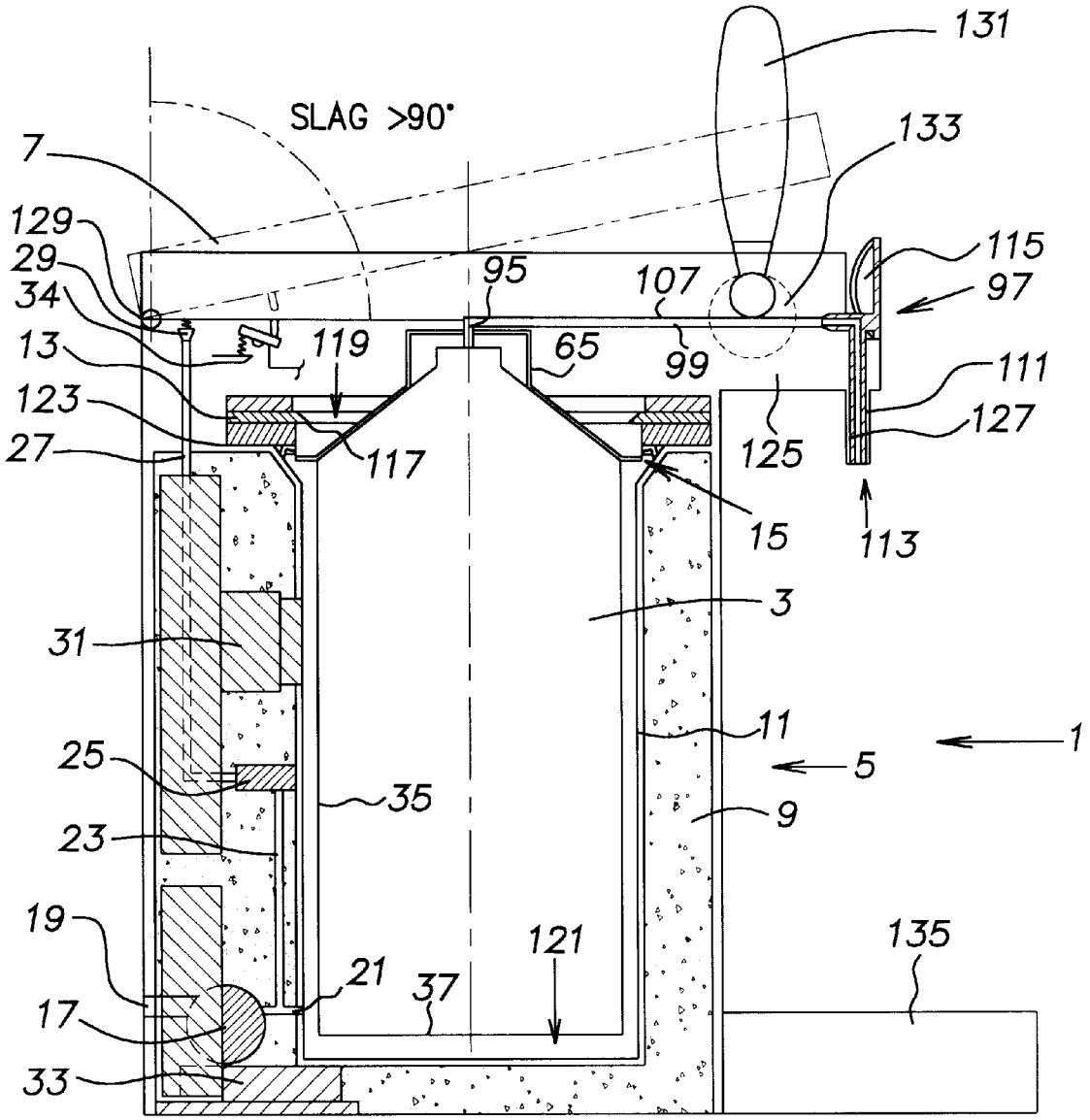
FIG. 1 is a diagrammatic, sectional side elevation of an assembly according to the invention.

The assembly shown in FIG. 1 comprises a tapping device and a beverage container 3 disposed therein. In the embodiment shown, the beverage container 3 is bottle-shaped and will be specified hereinbelow. The tapping device 1 comprises a box-shaped first part 5 and a cover 7 which is pivotally attached thereto and which can close the first part at the open side. FIG. 1 shows the cover 7 in the closed condition in full lines, and in an open condition in broken lines. The first part 5 comprises a circumferential wall 9 defining a receiving space for the beverage container 3, which space is to be referred to as pressure chamber 11. Extending along the top edge of the pressure chamber 11 are closing means 13 which can cooperate, in a manner to be described in more detail hereinbelow, with a closing part 15 of the container 3 and which can close off the pressure chamber 11 so as to be at least gastight and liquid-tight. During use, pressure built up in the pressure chamber 11 is entirely taken up by the container 3, the wall of the pressure chamber 11 and the closing part 15 together with the closing means 13. This prevents the cover 7 from having to take up this pressure. Hence, the opening and closing of the cover 7 can take place without any obstructions and without any danger, while, moreover, little closing force is required for the cover 7.

Accommodated in the wall 9 of the first part 5 is a pump 17 communicating, via a first line 19, with a source for a pressure medium, which, in the embodiment shown, is the ambient air. Further, via a second line, the pump 17 communicates with the pressure chamber 11 so as to be able to pump the pressure medium mentioned into the pressure chamber 11, under pressure. Via a pressure line 23, the second line 21 is connected to a pressure regulator 25, whereby the pressure in the pressure chamber can be controlled during use. Via a second pressure line 27, the pressure regulator 25 is connected to a safety valve 29 operated by the cover 7. When the cover 7 is being opened, the safety valve 29 is opened, whereby further pressure buildup in the pressure chamber 11 is prevented and any pressure built up therein is removed, which further increases the user's safety. Further, cooling means 31 are accommodated in the circumferential wall 9, which, via the wall of the pressure chamber 11 and pressure medium fed therein, provide for cooling of the beverage container 3. Moreover, control means 33 are accommodated in the circumferential wall 9, which are connected to at least the pump 17, the pressure regulator 25, the cooling means 31 and a pump switch 34, operated by the cover 7, for switching on the pump 17 when the cover 7 is being closed and switching it off when the cover 7 is being opened. The circumferential wall 9 is at least thermally insulated, as a result of which the beverage container 3, at least the contents thereof, can be maintained at a desired temperature in an energetically advantageous manner.

A tapping device 1 according to the invention is described in more detail in the Dutch patent application titled "Beverage dispensing device", filed by Philips Electronics B.V. on the same date, which patent application is assumed to be inserted herein by reference. Further parts of the device will moreover be described in relation to the beverage container and the use of an assembly according to the invention.

Figure 2:
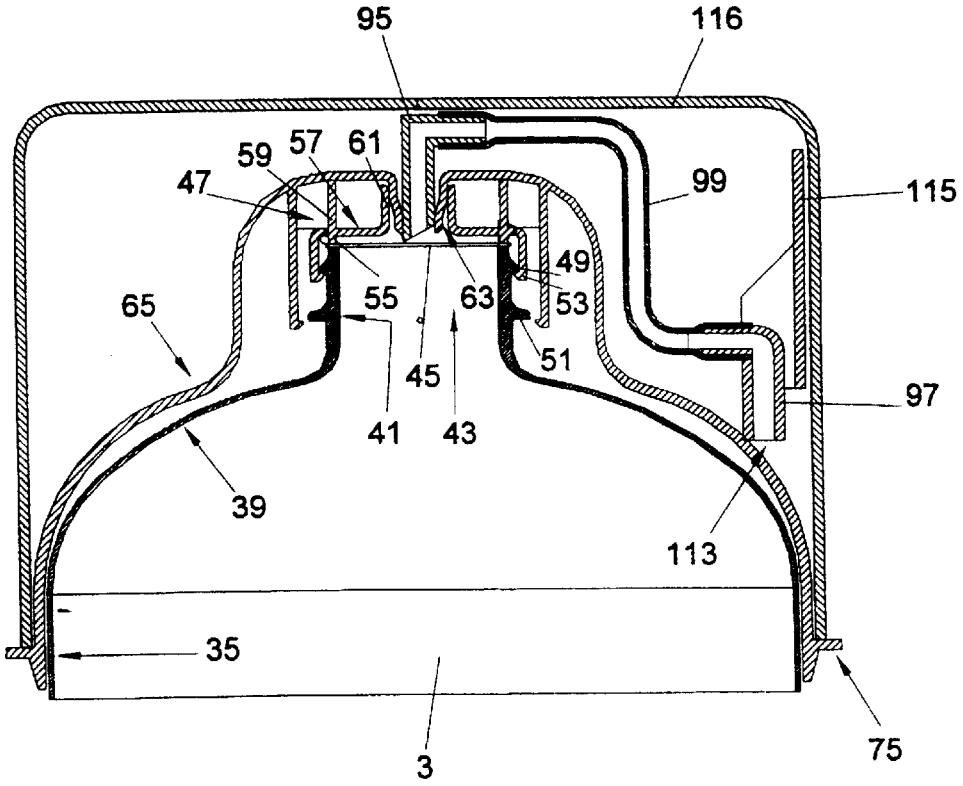
FIG. 2 is a sectional side elevation of the top end of a container for use in an assembly according to a preferred embodiment of the invention.
Figure 3:
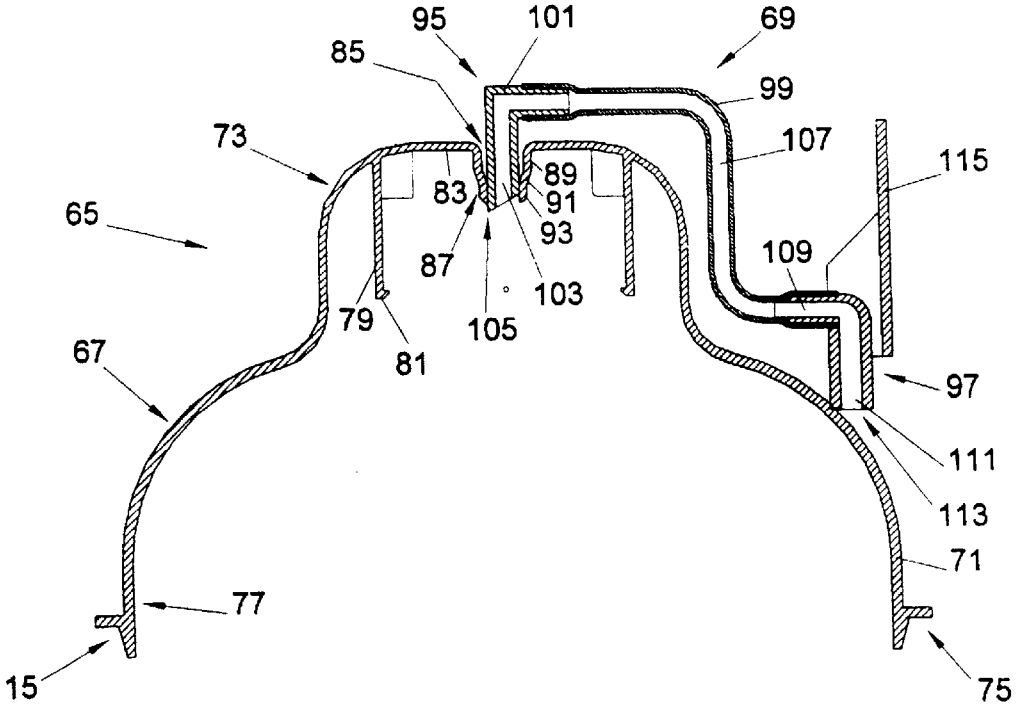
FIG. 3 is a sectional side elevation of a fit-on part for use in an assembly according to FIG. 1.

A beverage container 3 as shown in FIGS. 1 and 2 is bottle-shaped and designed for receiving a beverage, such as beer. As a matter of fact, other carbonated or noncarbonated beverages such as lemonade, soft drink or wine can also be received in such beverage container 3.

The beverage container 3 comprises a preferably cylindrical wall part 35, closed at a first end by a bottom 37. At the side remote from the bottom 37, a shoulder part 39 connects to the cylindrical wall part 35, which shoulder part comprises a cylindrical neck part 41. The neck part 41 encloses a dispensing opening 43 through which beverage can be introduced into and removed from the beverage container 3. The container 3 shown in FIG. 2 is preferably blown from plastic, for instance a polyester such as PET (polyethene terephthalate), PBT (polybutene terephthalate) or PEN (polyethene naphthalate). In particular PEN has the advantage that this plastic is particularly gastight, which is of great importance in particular when the beverage container 3 is used for storing a carbonated beverage, such as beer. Moreover, contamination and spoilage of the beverage in the beverage container 3 are thereby prevented. Because the beverage container 3 is blown so as to be bottle-shaped, it has no seams, which readily prevents it from tearing when the inside pressure is increased. As a matter of fact, a beverage container 3 according to the invention can also be manufactured in another manner or from a different material.

Provided on the neck part 41, over the dispensing opening 43, is a film-shaped tampering seal membrane 45, clamped on the longitudinal edge of the neck part 41 by means of a primary cap 47. The tampering seal membrane 45 seals the dispensing opening 43 so as to be at least temporarily airtight and liquid-tight. In particular when a beverage container 3 is used for packaging beer or a like perishable beverage, this is advantageous, because aseptic packaging of the beverage is thus possible. In particular when a beverage container 3 has a relatively large content, for instance more than 2 liters, this is advantageous, because when the beverage container 3 is filled aseptically, pasteurization of the beverage in the beverage container can be omitted. In the case of such large volumes, pasteurization of the beverage in the beverage container requires unacceptably much time. It is further observed that precisely in the case of such relatively large volumes, the use of a beverage container manufactured from the above-mentioned plastic according to the invention is particularly advantageous, because such beverage container is relatively light and has a relatively small surface relative to its volume, as a result of which any problems regarding the gas permeability of the material of the beverage container are removed even further. These advantages increase when the volume of the beverage container increases. Such beverage container is suitable particularly for packaging beer whose taste or composition is in particular highly susceptible to oxygen attack. Generally, lager is far more sensitive to oxygen than ale. For lager, this sensitivity as spoiling limit lies at about 1–2 ppm (=mg/l) in six months, while for ale this is much higher, for instance three or more times that value in the same period. Hence, a good oxygen barrier is much more important for lager than for ale. In addition, such package is also suitable in particular for beverages having a high $CO_2$-content, for instance higher than 3 g/kg. For that reason, too, a package according to the invention is particularly suitable for packaging lager, having a $CO_2$-content of for instance 4.8–5.4 g/kg, while the $CO_2$-content of ale is for instance about 3 g/kg. It will be understood that a package according to the invention is in fact also excellently suitable for packaging ale and other beverages, also when the container is less compressible.

Around the outside of the neck part 41, two circumferential edges 49, 51 extend one above the other. By means of suitable hooking means 53, for instance an annular snap edge, the primary cap 47 is fixed behind the top circumferential edge 49, in such manner that a clamping edge 55 abuts against the top side of the tampering seal membrane 45 along the circumferential edge thereof, and presses this membrane against the longitudinal edge of the neck part 41. The primary cap 47 comprises a main face 57 which largely covers the dispensing opening 43. The hooking means 53 extend from this main face in a first direction. From the main face 57, a first tubular part 59 extends in the direction away from the hooking means 53, in line with the clamping edge 55. Extending concentrically within the first tubular part 59, from the main face 57, is a second tubular part 61, which encloses a continuous opening 63 through the primary cap 47. The height of the second tubular part 61 above the main face 57 is slightly less than the height of the first tubular part 59 above this main face 57.

On the primary cap 47, a fit-on part 65 is provided. Such fit-on part is shown separately in FIG. 3.

The fit-on part 65 comprises a secondary cap 67 and a dispensing device 69. The secondary cap 67, preferably manufactured from plastic or light metal, comprises a bowl-shaped shell part 71 having a central, likewise shell-shaped bulge 73. Extending outwards, along the longitudinal edge of the shell part 71 remote from the central bulge 73, is a circular closing edge 75, which forms at least partly the closing part 15 for cooperation with the closing means 13 of the tapping device. On the side remote from the central bulge 73, the shell part 71 has a substantially cylindrical part 77 whose inside can abut with a proper fit against the outside of the cylindrical part 35 of an undeformed beverage container 3. The shell part 71 extends along a portion of the shoulder part 39, while the neck part 41 of the beverage container 3 is received in the central bulge 73. Extending inwards from the top end of the central bulge 73 is a cylindrical wall 79 provided, along the free longitudinal edge thereof, with inwardly extending second hooking means 81. These second hooking means can engage below the second circumferential edge 51 around the neck part 41 of the beverage container. Provided centrally in the top face 83 of the bulge 73 is a passage opening 85, enclosed by a sealing sleeve 87 which extends inwards, concentrically with the cylindrical wall 79. The sealing sleeve 87 has a wide first part 89 located adjacent the top face 83 of the central bulge 73, and a second, relatively narrow part 93 which connects thereto via a frustoconical part 91. The relatively wide first part 89 has an outside diameter such that it can be received with a proper fit, preferably slightly clampingly, in the second tubular part 61 of the primary cap 47. The height of the sealing sleeve 87 approximately corresponds to the height of the second tubular part 61.

The dispensing device 69 comprises a tubular first coupling part 95, a second tubular coupling part 97, and a connecting part 99 which connects the two coupling parts and which is at least slightly flexible and preferably hose-shaped. The first coupling part 95 is knee-shaped, with the connecting part 99 fixed on a first leg 101. The second leg 103 has an outside diameter such that it can fittingly and sealingly abut against the inside of the second, relatively narrow part 93 of the sealing sleeve 87. The second leg 103 is movable within the sealing sleeve 87 in a direction parallel to the central axis of the cylindrical wall 79, at least to the longitudinal direction of the beverage container 3. The free end of the second leg 103 is cut off slightly obliquely, to obtain a slightly sharp tip 105. During a relative downward movement of the first coupling part 95, i.e. a movement relative to and in the direction of the beverage container 3, the tip 105 is moved through the tampering seal membrane 45 to create a free communication between the inside of the beverage container 3 and the channel 107 which extends through the dispensing device 69. The at least liquid-tight sealing between the neck part 41 and the primary cap 47, possibly with the interposition of the tampering seal membrane 45, and the likewise at least liquid-tight sealing between the second tubular part 61 of the primary cap 47 and the wide first part of the sealing sleeve 87 on the one hand and the relatively narrow part 93 of the sealing sleeve 87 and the second leg 103 of the first coupling part 95 on the other, provide that liquid from the beverage container 3 can only be dispensed via the dispensing channel 107 and, hence, cannot flow into the pressure chamber 11. This prevents waste of beverage and, moreover, fouling of the tapping device 1.

The second coupling part 97 comprises a likewise knee-shaped element, of which the first leg 109 is coupled to the end of the connecting part 99 remote from the first coupling part 95, while the second leg 111 encloses a free dispensing opening 113. Shaped integrally with, or at least attached to, the second coupling part 97 is a shield-shaped engaging element 115, which element simplifies manipulation of the second coupling part 97. On the engaging element 115, markings can be provided, for instance printings such as a brand name, logo, indication for the content of the beverage container, delivery or expiry date, or the like. As will be further explained hereinbelow, the engaging element 115 always extends outside the tapping device 1 during use, so that the printing mentioned is visible from the outside. Of course, identification means can also be provided on the engaging element 115 in another manner, for instance by a relief or by cuttings.

In the condition shown in FIG. 2, an outside cap 116 is provided over the secondary cap 67 and the dispensing device 69, which outside cap abuts against the top side of the closing edge 75 and protects at least the dispensing device 69 against fouling from outside.

A beverage container 3 can be placed in the first part 5 of the tapping device as follows.

The beverage container 3 is positioned with its bottom 37 above the open side of the pressure chamber 11 and moved down vertically until the closing edge 75 abuts against the top side of the closing means 13. In the embodiment shown, the closing means 13 are designed as closing segments 117 which can be moved outwards in a horizontal plane against a spring pressure and which, in the maximally outwardly moved position, define a passage opening large enough to be passed by the closing edge 75. At their inwardly facing ends, the segments 117 have an inwardly inclined top face 119 which provides that upon a vertical pressure, exerted thereon by the closing edge 75, the segments 117 are displaced outwards to allow the closing edge 75 to pass. After the closing edge has moved past the segments 117, the segments 117 are moved back into their starting positions by the spring pressure, while enclosing the beverage container 3 in the pressure chamber 11. When the pressure chamber 11 is pressureless, a full beverage container 3 is, on account thereof, surrounded by some space on the outside thereof, with the bottom 37 of the beverage container 3 standing on the bottom 121 of the pressure chamber 11. Accordingly, there is some space between the top side of the closing edge 75 and the bottom side of the segments 117. Included between the circumferential wall 9 and the closing edge 75 is a sealing section 123 which is slightly V-shaped. The open side of the sealing section 123 faces towards the pressure chamber 11, so that during pressure buildup in the pressure chamber, the sealing action of the sealing section 123 is increased.

After the beverage container 3 has been inserted into the pressure chamber 11 in the manner described, the fit-on part 65 extends substantially outside the pressure chamber 11, such that the engaging element 115 can be engaged from the outside of at least the pressure chamber 11.

From the top side of the circumferential wall 9, a support part 125 extends approximately horizontally on one side of the tapping device 1, which support part comprises a tube part 127 which extends approximately vertically from the bottom side thereof. Through the support part 125 and the tube part 127, a passage extends in which the second leg 111 of the second coupling part 97 can be received with a proper fit, the dispensing opening 113 being adjacent thereto, preferably outside the free end of the tube part 127. The engaging element 115 renders positioning of the second leg 111 in this passage possible in a particularly simple manner. In this condition, the connecting part 99 extends approximately horizontally on the top face of the support part 125, possibly in a groove formed therein.

Via a pivot 129, the cover 7 is connected to the first part 5 of the tapping device 1, on the side of the top end of the longitudinal wall 9 remote from the support part 125. On the side of the cover which, during use, faces the tube part 127, an operating handle 131 is included in the cover 7, which operating handle 131 is movable between an approximately vertical and an inclined position. At the end of the operating handle 131 which is incorporated into the cover 7, an eccentric is attached which abuts against the connecting part 99. When the operating handle is in the vertical position shown in FIG. 1, the connecting part 99 is pressed shut by the eccentric 133, whereby the channel 107 is closed. By moving the operating handle 131 into the inclined position, the connecting part 99 is at least partially released by the eccentric 133, so that the connecting part can resume its original form at least partially and the channel 107 is at least partially released for letting through beverage from the beverage container 3. By means of simple, known per se locking means, not shown, the cover 7 can be secured in the closed position.

During the positioning of the beverage container 3 in the first part 5 of the tapping device 1, the first coupling part 95 is in a topmost position, entirely above the tampering seal membrane 45, as shown in FIG. 2. When the cover 7 is closed, the first coupling part 95 is pressed down, or at least retained, as a result of which the first coupling part 95 cannot be moved up. Moreover, when the cover 7 is closed, the pump switch 33 is operated, whereby the pump 17 is put into action, while, further, the safety valve 29 is closed, enabling pressure to be built up in the pressure chamber 11 by pumping into it the pressure medium mentioned, for instance outside air. As a matter of fact, a different pressure medium may also be applied, for instance water or carbonic acid. Because the pressure medium does not contact the beverage in the beverage container 3 during use, such pressure medium does not affect the quality of the beverage.

During the buildup of pressure in the pressure chamber 11, which is only possible when the cover 7 is closed, the beverage container 3 is moved up, in the direction of the closing segments 117. Thus, an optimal sealing of the pressure chamber 11 is obtained. Moreover, during this vertical movement, the tip 105 of the first coupling part 95 is forced through the tampering seal membrane 45, enabling beverage to be fed from the beverage container 3 to the channel 107. This means that when the operating handle 131 is thereupon moved out of the vertical position, beverage can be discharged via the dispensing channel 107 and the dispensing opening 113, so that for instance a glass of beer can be tapped. Adjacent the bottom side of the tapping device, under the dispensing opening 113, a receptacle 135 is arranged for receiving beverage spilled from the dispensing opening 113. This further prevents fouling of the environment.

During use, the pressure in the pressure chamber 11 is increased by means of the pump 17 such that the wall of the beverage container 3 is compressed, in order to reduce the volume of the beverage container 3, while beverage is dispensed via the channel 107 and the dispensing opening 113. Surprisingly, it has been found that a plastic beverage container of the type described can be compressed substantially completely by means of the pressure in the pressure chamber 11, so that substantially all beverage can be removed from the beverage container 3 in the above manner. As the fit-on part 65 with its closing edge 75 located relatively far from the neck part 41 is secured below the segments 117, while the fit-on part is connected to the neck part 41 via the primary cap 47, it is possible that the entire beverage container 3 is deformed to within the secondary cap 67, while deformation of the shoulder part 39 of the beverage container 3 is also possible. A further advantage of this manner of attachment is that the secondary cap 67 can be of a relatively rigid design and the beverage container 3 can be of a relatively flexible design, while in each case, the secondary cap 67 continues to provide a proper sealing of the pressure chamber. This means that deformations or displacements of the beverage container 3 relative to the fit-on part 65 do not affect the sealing of the pressure chamber 11. The construction of the fit-on part 65, in particular the tampering seal membrane 45 and the first coupling part 95, offers the advantage that the beverage container 3 can be positioned in the pressure chamber 11 before the beverage container is opened, while when the pump 17 is switched on, an optimal closing of the pressure chamber 11 is provided and, at the same time, the beverage container 3 is opened. Here, the fit-on part 65 forms at least a portion of the wall of the pressure chamber 11, so that in the absence of a beverage container 3 in the tapping device 1, no pressure can be built up in the pressure chamber. This is of particular importance for the safety of a user. Moreover, this precisely provides the possibility of operating the tip 105 of the first coupling part 95 from outside the pressure chamber 11. Because the closing edge 75 is spaced from the dispensing opening 43 by a relatively large distance, relatively great tolerances can be received in the fit-on part 65 without the sealing action between the closing part 17 and the closing means 13 being adversely affected thereby, while the dispensing opening 43 is always optimally positioned. Indeed, deformations resulting from relatively great tolerances are simply received by deformations of the fit-on part 65. This means that the closing means 13 may be of a simple and relatively light Construction.

The construction of the fit-on part 65 and the first part 5 of the tapping device 1 cooperating therewith moreover offers the advantage that a beverage container 3 can be inserted into the tapping device vertically, while the cover 7 can be pivotally connected to the circumferential wall 9 of the tapping device. This further simplifies the insertion of the beverage container 3 and positioning of the cover 7. For removing the emptied beverage container 3, mechanical means may be provided for moving the segments 117 outwards such that the fit-on part 65 can be removed together with the emptied beverage container 3. Because the closing pressure on the segments 117 acts in a direction approximately at right angles to the working direction of the springs of the segments 117, the bias of the segments 117 can be relatively low, so that such outward adjustment is possible in a relatively simple fashion. When the beverage container 3 has been emptied entirely, the pressure in the pressure chamber 11 is let off, possibly by means of the pump 17, after which the cover 7 can be opened and the compressed beverage container 3, together with the fit-on part 65, can be removed from the tapping device and be discharged, for instance to a reprocessing apparatus suitable therefor. As the beverage container 3 will have been compressed within the fit-on part 65 at least almost entirely, an empty beverage container 3 according to the invention occupies only little space, which is favorable from a logistic point of view.

Figure 4:
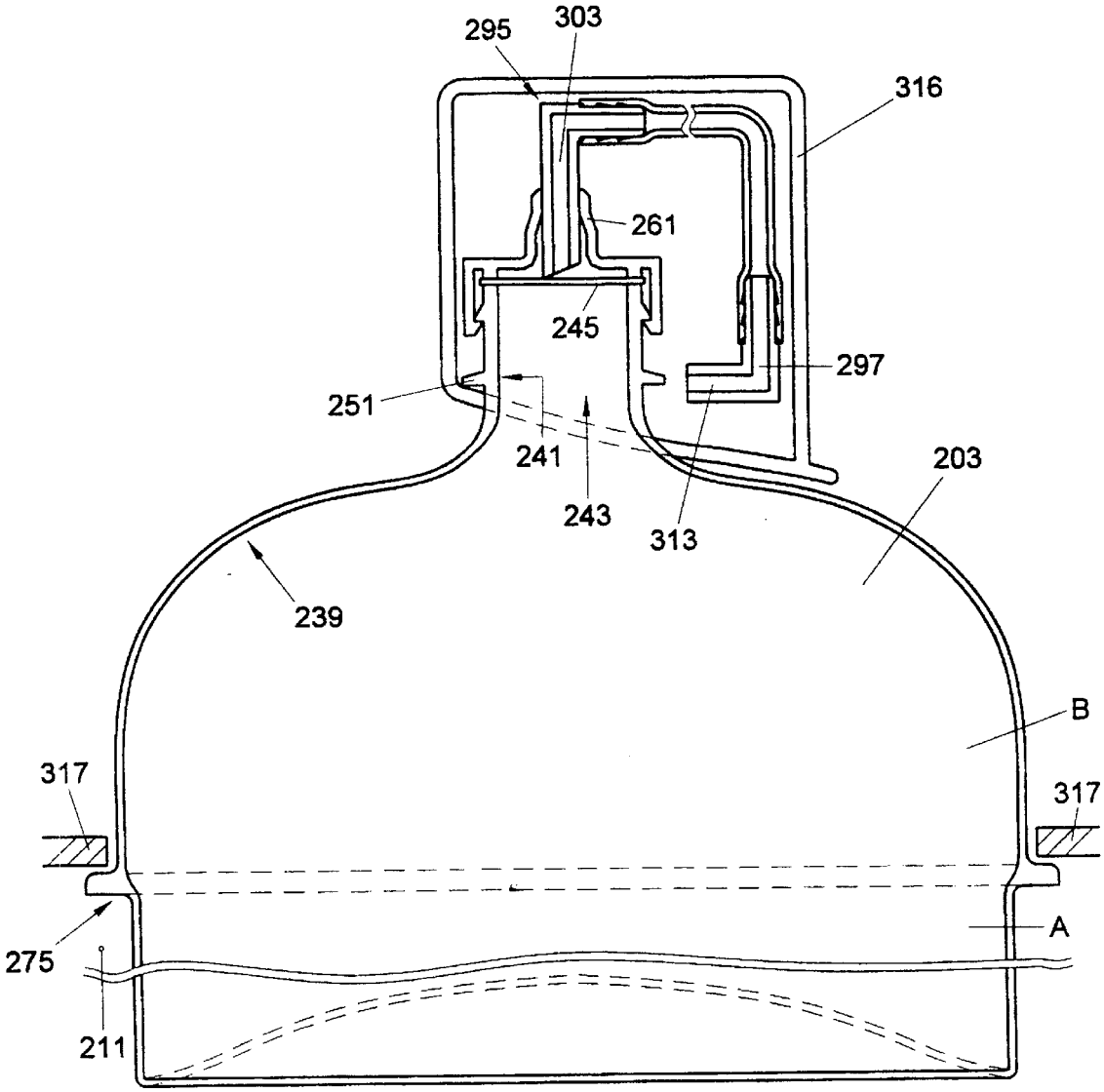
FIG. 4 is a sectional side elevation of the top end of a container in an alternative embodiment, for use in an assembly according to the invention.

FIG. 4 shows an alternative embodiment of the top end of a beverage container 203 according to the invention for use in a tapping device 1 as shown in FIG. 1. Corresponding parts have corresponding reference numerals, having 200 added thereto.

In this embodiment, a closing edge 275 is fixedly connected to the bottom end of the shoulder part 239 of the beverage container 203. The closing edge 275 is preferably formed integrally with the beverage container 203. In this embodiment, a primary cap 247 is provided, whose construction approximately corresponds to that of the primary cap 47 as shown in FIG. 2. In this embodiment, however, the second tubular part 261 has at least partially such an inside section that this second tubular part 261 can sealingly and guidingly abut against the second leg 303 of the first coupling part 295. This embodiment is constructionally relatively simple, but at least the closing edge 275 should be of such a stiff construction that the closing edge 275 cannot deform during use, or only to a very slight degree, so as to maintain a sufficient sealing of the pressure chamber 211.

The closing edge 275 can be arranged in the container at a relatively low position, for instance at the center thereof, with the locking means 317 also being arranged at a low position. When the container 203 is compressed, the part A of the container 203 extending below the closing edge 275 will be pressed inwards upwardly, as indicated in broken lines in FIG. 4. In this regard, displacement of the cylindrical wall of the bottom part A of the container 203 inwards -relative to the cylindrical wall part of the top part B of the container, has the advantage that it is guaranteed even better that the entire bottom part A will be forced into the upper part B; while forcing beverage out of the beverage container 203. In this embodiment, the compressibility of the bottom part A is optimally utilized due to the relatively low stiffness in inward direction thereof, while moreover, the relative undeformability of the shoulder 239 under internal pressure in the container is utilized in an optimal manner. As a result, the closing edge 275 will be held in contact with the locking means 317 in a relatively simple manner. It will be understood that the container 203 will, or at least can be of a longer design than is shown in FIG. 4. Further, it will be understood that in this embodiment, the closing edge may also be located at a relatively high position, and the container is compressed in a manner described hereinabove or is provided with a membrane or another separating and displacing means as described in the present application.

Figure 5:
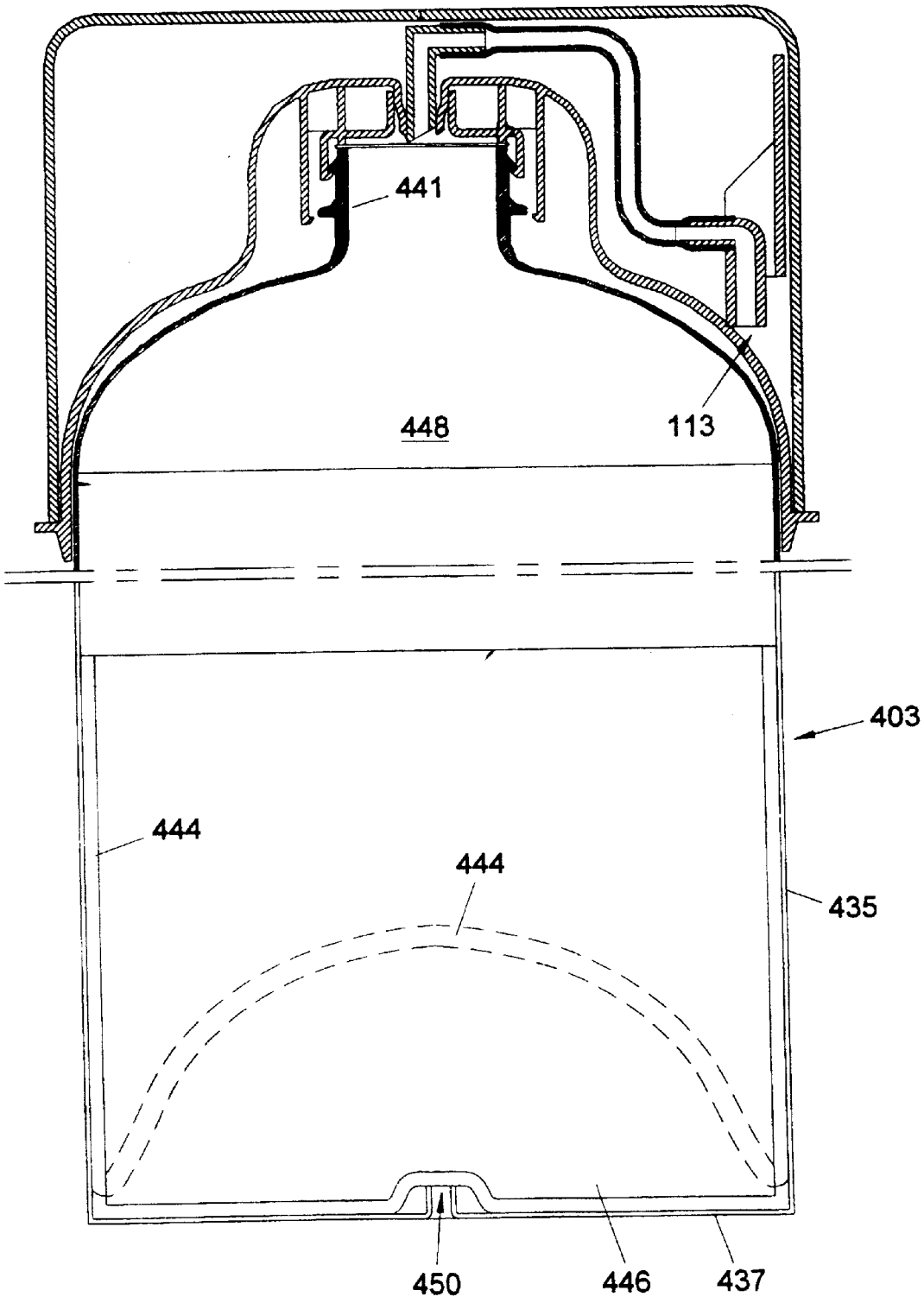
FIG. 5 is a diagrammatic, sectional side elevation of a container for use in an assembly according to the invention, in a further alternative embodiment.

FIG. 5 shows a further alternative embodiment of a beverage container 403, for use in a tapping device 1 according to the invention, which beverage container is substantially formed from a material which, at least under the influence of the service pressure in the pressure chamber, is substantially undeformable. Corresponding parts have corresponding reference numerals, with 400 added thereto. Such beverage container can for instance be substantially manufactured from metal. Provided in the beverage container is a membrane 444 whose longitudinal edge is connected to the wall 435 of the beverage container 403, between the bottom 437 and the neck part 441. The membrane 444 is flexible such that in a first position, as shown in FIG. 5, it can abut against the bottom portion of the wall 435 and the bottom 437 of the beverage container 403. The membrane 444 separates the beverage container 403 into a pressure compartment 446 located between the membrane 444 and the bottom 437, and a storage compartment 448 located between the membrane 444 and the neck part 441. When a beverage container 403 is completely filled, as shown in FIG. 5, the membrane 444 abuts against the bottom 437. Provided in the bottom 437 is a pressure opening 450, which preferably forms an open communication between the pressure compartment 446 and the environment. Hence, when a beverage container 403 as shown in FIG. 5 is inserted, in a manner described hereinabove, into a tapping device 1 according to the invention, the pressure chamber 11 is in direct communication, via the pressure opening 450, with the pressure compartment 446 in the beverage container 403. Hence, when the pressure in the tapping device 1 is increased, a part of the pressure medium will flow from the pressure chamber 11 into the pressure compartment 446 while displacing the membrane in the direction of the neck part 441. Accordingly, the content of the storage compartment 448 is reduced and, when the channel 507 in the connecting part 499 is released, beverage is dispensed by the tapping device 1. The membrane 444 can be displaced so that the content of the pressure compartment 446 is maximal and the content of the storage compartment 448 is minimal, preferably almost nil. Hence, in this manner, the complete storage compartment 448 can be emptied. A beverage container 403 can further be constructed as shown in FIG. 2 or FIG. 4. Constructionally, at least as far as design and positioning of the membrane are concerned, a beverage container as shown in FIG. 5 is described in more detail in the FIGS. 8–16C and the relevant part of this description. Such beverage container 403, to be referred to as membrane barrel, offers inter alia the advantage that such beverage container can be used several times, which can be advantageous from an environmental viewpoint. Moreover, deformable parts, in particular the membrane, are protected by the wall of the beverage container during, inter alia, transportation and storage, so that damages to the beverage container are readily avoided.

FIG. 6 shows a further alternative embodiment of a device according to the invention, comprising a beverage container 503 which is receivable in the tapping device 501, comparable with the tapping device 1 as shown in FIG. 1. The tapping device 501, in particular the wall 509, is shown only diagrammatically and in so far as it is necessary for a proper understanding of the invention. The beverage container 503 comprises an upright cylindrical longitudinal wall 535 and a shoulder part 539, the longitudinal wall 535 being connected to the shoulder part 539 by a vertical wall part 500 which is displaced slightly outwards relative to the cylindrical wall 535 and extends around the circumference of the beverage container 503. The bottom side of the vertical part 500 beds down on an outwardly extending flange part 512 of the wall 509, so that the beverage container cannot move down from the position shown. Fitted on the flange part 512 is a circular ring 514, which is formed from a slightly flexible material such as rubber and which has its inside provided with an upper circular lip 516 and a lower circular lip 518, between which lips a pressure chamber 520 is formed. During use, the upper 516 and lower lip 518 abut with elastic deformation against the outside of the vertical wall part 500, sealing the chamber 520 hermetically. Provided in the vertical wall part 500 is at least one and preferably a series of openings 522, connecting the inside of the beverage container 503 to the pressure chamber 520. Via a feed line 521, the pressure chamber 520 communicates with a pump for feeding air or another pressure medium. Provided over the ring 514 is a reinforcement section 524 for confining the ring so as to be form-retaining. In the embodiment shown in FIG. 6, a relatively elastic, at least deformable bag 544 formed from foil is included in the beverage container 503, which bag is suspended, at least attached, adjacent the dispensing opening 43. This will be discussed in more detail hereinbelow. It is further observed that instead of the deformable bag 544, a deformable bottle of the type described hereinabove can be used in an embodiment as shown in FIG. 6. The wall of the bag or bottle 544 is preferably substantially oxygen-impermeable, for reasons described hereinabove. Moreover, the advantage thus achieved is that the wall of the container can be thin and constructed from relatively inexpensive material, as it does not have to be oxygen-impermeable, or only to a lesser degree. However, when the wall of the container is of an oxygen-impermeable construction as well, an even better protection of the beverage in the storage compartment is obtained. If so desired, the container may be of divisible design, enabling the bag or bottle 544 to be changed, like the above-described embodiment having a membrane, as shown in FIG. 5.

In the embodiment shown diagrammatically in FIG. 6, the pressure medium can during use be fed through the openings 522 into the inner space of the beverage container, between the bag 544 and the longitudinal wall 535. This allows the bag to be compressed while displacing the beverage contained therein. Because the passage openings 522 are provided adjacent the shoulder part, the beverage container 503 may have any length desired as long as it can be included in the tapping device 501. This means that with the same tapping device, beverage containers of different sizes can be used. During use, excess pressure is created in the pressure chamber 520, whereby the upper 516 and lower lip 518 will be displaced and pressed more firmly against the vertical wall part 500 of the beverage container, so that an even better sealing is obtained while, moreover, deformations can be taken up thereby more simply.

In the embodiment shown in FIG. 6, a cylindrical neck part 541 connects to the top end of the shoulder part 539. In the neck part 541, a connecting sleeve 552 is slidably accommodated, whose downstroke is limited by a ridge edge 551 which extends inwards adjacent the bottom side of the neck part 541 and against which a first flange 558 of the connecting sleeve 552 strikes. Arranged at some distance below-the first flange 558 on the connecting sleeve 552 is a second flange 554, on which the bag 544 is sealingly secured. The first 558 and second flange 554 extend at right angles to a cylindrical wall 556 defining the dispensing opening of the bag 544. On this cylindrical wall 556, a film-shaped tampering seal means 545 is sealingly provided. This tampering seal means extends horizontally, parallel to the two flanges. Above the tampering seal means 545, the cylindrical longitudinal wall 556 is continued in a cylindrical longitudinal wall 556*a*, connected at its top end 560 to a flexible, resilient membrane 562 which is circular and has its outer longitudinal edge secured on the top end of the neck part 541. At the center of the membrane 562, a knee-shaped connecting part 595 extends therethrough, which is comparable with the first coupling part 95 as shown in, for instance, FIG. 1. Connected to this coupling part is a connecting hose 599 for coupling to the tapping means, as described hereinabove. The coupling part 595 is fixedly connected to a primary cap 547 which is secured on the neck part 541 by means of a longitudinal edge under a ridge 549. The primary cap 547 comprises a closed top face 564 extending above the resilient membrane 562. Above the cylindrical wall 556 of the connecting sleeve 552, the top face 564 is bent upwards, as a result of which a space is left clear between the membrane 562 and the bottom side of the top face 564 when the connecting sleeve is in its lowermost position. The end of the coupling part 595 facing the membrane 545 is sharp.

An assembly according to FIG. 6 can be used as follows.

By means of the pump 517, a pressure medium is introduced via the pressure chamber 520 into the pressure space 511 between the bag 544 and the wall 535 of the container 503, causing a pressure buildup in the bag 544. Accordingly, the connecting sleeve 552 is pressed away upwards, inter alia by pressure exerted on the flange 558. This involves the resilient membrane being moved up against the bottom side of the top face 564, while the sharp end of the coupling part 595 is forced through the film 545, thereby releasing the passage of the line 599 to the inner space of the bag 544. The membrane 562 and the primary cap 547, in particular the top face 564 thereof, provide an airtight and liquid-tight sealing of the neck part 541. Such embodiment of an assembly according to the invention is particularly simple and practical in use.

FIG. 7 shows a further alternative embodiment of at least a top part of a beverage container 603 according to the invention, positioned in a tapping device 601, for instance as shown in FIG. 1. Of the tapping device 601 and the beverage container 603, only those parts are diagrammatically shown that are relevant for a proper understanding of this embodiment. The other parts have already been described in detail.

In the embodiment shown in FIG. 7, the fit-on part 665 is of a two-piece construction, with a first, central part 666 being fixed connected to the beverage container, while a second, annular part 668, located adjacent the wall 609 of the tapping device 601 during use, can be fitted loosely or is for instance pivotally connected to the tapping device and can be closed over the beverage container. Adjacent the dispensing opening, the first central part 666 is connected to the bottle-shaped beverage container 603 in one of the manners described hereinabove, for instance by the use of the primary and secondary caps. Along the outer longitudinal edge, the first part 666 comprises a downwardly extending longitudinal edge 670, while from the bottom edge thereof, a second longitudinal edge 672 extends, downwardly inclining outwards. The annular second part 668 is provided, along its inner longitudinal edge, with a sealing section 674 which can sealingly abut against the longitudinal edges 670 and 672. From the section 674, an inclined face 676 extends outwards down to a second sealing section 678, which extends outwards from the outer longitudinal edge of the second part 668 and can abut against the inside of the longitudinal wall 609 of the tapping device 601. By locking means not shown in FIG. 7, as shown in for instance FIG. 1, the fit-on part 665 can be retained in the tapping device 601 through engagement with the top side of the second part 668.

On the central part 666, an outside cap 716 is secured over the dispensing means by means of resilient projections 680 which are connected to the first part 666 and extend through openings in the outside cap. During positioning of the second part 668 of the fit-on part 665, it is slid over the outside cap 716, with the resilient projections 680 being pressed away inwards by a resilient edge 682 on the second part 668, while releasing the outside cap 716. The advantage thus achieved is that the beverage container 603 can be engaged at the outside cap 716 during the positioning thereof in the tapping device 601, without possibly becoming detached. After all, it is retained by the resilient projections 680. This easily enables manipulation of the beverage container 603 during positioning. Moreover, the dispensing means, in particular the piercing means, are prevented from being operated prematurely, because during positioning, they remain protected by the outside cap 716. Not until the beverage container 603 is secured in the tapping device by means of the second part 668 of the fit-on part 665 and the locking means 717, can the outside cap 716 be removed, whereupon the connecting means can be positioned in a manner described hereinabove and the cover of the tapping device 601 can be closed. This readily enables a hygienic and safe positioning of the beverage container. The securing means for the outside cap on the beverage container are shown only diagrammatically and can of course be constructed in many other suitable manners. The two-part construction of the fit-on part 665 has the advantage that the first part 666, which remains connected to the beverage container, can be of a relatively simple, light and inexpensive design, and can be removed with the beverage container while the second part 668 can be rendered suitable for repeated use by a suitable choice of materials and design. As a result, the forces occurring can moreover be taken up and transmitted even better. Further, such embodiment has environmental advantages when the beverage container is entirely or partially of the disposable type.

A beverage container 3, 203, 403, 503, 603, 701, 801, 901 according to the invention has the advantage that the dispensing means can be supplied with the beverage container and can also be discharged therewith. This means that during use, the beverage from the beverage container does not contact the parts of the tapping device 1 other than by the dispensing means mentioned. Thus, fouling of the tapping device is prevented in a simple manner, so that during a change of a beverage container, cleaning operations can be omitted. This is pleasant to the user and moreover environmentally advantageous, because the necessity of using cleaning agents is avoided. Moreover, this avoids taste problems being caused during a change of a beverage container when the contents of the container to be removed were different from those of the new container to be positioned. A further advantage of this is that there is always a direct connection between the shield-shaped element and the contents of the beverage container, so that it is always clear to the user which type of beverage will be dispensed from the tapping device. Thus, mistakes are readily prevented. Of course, at least a part of the dispensing means may be suitable for reuse.

FIG. 8 shows a container 701 according to the invention, in sectional view. The container 701 is barrel-shaped and comprises a container body 702, built up from a cylindrical longitudinal wall 703, a bottom 704 and a shoulder part 705. The container body 702 is substantially gastight and liquid-tight, except for a connecting opening 706, to be further discussed hereinbelow, in the bottom 704 and a dispensing opening 707 in the shoulder part 705. Between the bottom 704 and the shoulder part 705, a membrane 708 is attached to the wall 703, which membrane separates the connecting opening 706 from the dispensing opening 707. In its starting condition, i.e. before it is placed in the container 701, the membrane 708 is preferably circular and has a diameter larger than the diameter of the wall 703. The membrane 708 divides the container into a bottom compartment 709, henceforth referred to as pressure chamber 709, and a top compartment 710, henceforth referred to as storage compartment 710.

In the condition shown in FIG. 8, the storage compartment 710 is maximally filled with a beverage to be dispensed, as a result of which the membrane is forced against the part of the wall 703 extending therebelow and against the bottom 704, over the connecting opening 706. In this condition, the membrane 708 preferably abuts substantially without tension or slightly elastically stretched, against the inside of the container 701.

At its top side, the container 701 comprises closing means 711 in the form of a relatively large cap, which, in the embodiment shown, covers the entire shoulder part 705. The cap 711 is provided with a top face 719 and an annular apron 712. Adjacent its free longitudinal edge, the apron 712 is provided with an annular groove 713 which is open on the inside and in which an annular edge 714 of the container 701 is receivable with a proper fit. This annular edge 714 is for instance formed by a wall part which is displaced outwards at some distance below the shoulder part 705. The edge 714 preferably has such a shape that the cap 711 cannot be removed from the container 701 without damaging the cap 711 and/or the edge 714. To that end, the edge 714 may for instance be provided with a relatively sharp edge part 715 which, during a vertical movement of the cap 711, cuts into the groove 713. In fact, the edge 714 may of course also be provided on the cap 711 and the groove 713 may be provided in the wall of the container 701, while the edge 714 may also be separately manufactured and mounted on the container 701 or the cap 711. Further, it is of course also possible to fixedly connect the cap 711 to the container 701 by means of gluing or like techniques, also when the cap 711 has a smaller diameter than the container 701, or a shape different therefrom. It is important, yet not essential, that the cap 711 cannot be removed from the container 701 and possibly be placed back thereon in an unrecognizable manner, so that the space 716 within the cap 711 is and remains closed from the outside world until it is actually used, as will be further described hereinbelow.

A flexible dispensing hose 717 has its first end connected to the dispensing opening 707, and has its opposite end provided with coupling means 718 for coupling that end to a tapping device T, to be further indicated hereinafter. The cap 11 has its top face 719 provided with an opening 720 in which, via a number of tampering seal lips 721 (FIG. 11), a cover part 722, which can be broken away, is mounted so as to cover the opening 720. The dispensing hose 717 is mounted on the side of the cover part 722 facing the inner space 716, adjacent the coupling means 718. Upon the removal of the cover part 722 from the opening 720 by breaking the tampering seal lips 721, the dispensing hose 717 is at least partially pulled to a position outside the cap 711, in such a manner that the coupling means can be connected to the tapping device T. In fact, the hose 717 may also be located inside the cap 11 loose from the cover part 722, where it can be engaged through the opening 720 upon removal of the cover part 722. Many variations thereto are possible, as well as to the arrangement of the opening 720 in the cap 711. By coupling the cover part 722 to the dispensing hose 717 adjacent the coupling means 718, the cover part 722 will always be visible at the tapping device T. Useful information can be provided on the cover part 722, for instance an indication of the contents of the container, brand and advertising, which always remains visible during use of the tapping device.

Because prior to use, the cover part 722 closes the opening 20 entirely, while the dispensing means 77, 717, 718 are confined under the cap 711, manipulation of the contents of the container and/or the dispensing means is readily prevented.

A container according to FIG. 8 can be used as follows.

The container 701 is connected with its bottom 4 to a pressure source 724 (FIG. 10), for instance by positioning it in a receiving part 725, with a pressure line 726 being automatically connected in the connecting opening 706 in the bottom 704. For that purpose, the connecting opening may be slightly elevated from the bottom face 704, to create a dent 727 in the bottom 704. In the connecting opening 706, preferably a non-return valve or like valve means is incorporated, which is automatically opened or closed by coupling or decoupling respectively the pressure line. This prevents gas or liquid from flowing from the pressure chamber when the container is being detached. In the same manner, the pressure line may be provided with such means. The container is fixed on or in the receiving part 725, for instance by clamping means or by a screw thread connection 728 with the wall of the container 701.

In FIG. 10, the screw thread connection 728 is provided adjacent the circumference of the bottom of the container, so that only containers having the relevant section can be positioned in the bottom part 725. In FIG. 10A, the screw thread connection 728 is provided around the end of the connecting line 726 in the dent 727. This means that the screw thread connection 728 has a relatively small section, while the forces on the coupling in question will be relatively low. Moreover, the advantage thus achieved is that containers having different diameters can be connected to the same device in the same manner. Of course, other connecting means may be opted for, for instance a bayonet closure or quick-acting coupling, or like coupling means that are known to anyone skilled in the art.

When the container 1 is connected to the pressure source 724, the cover part 722 can be broken apart and the flexible hose 717 can be pulled from the space 713 partially, to a position outside the cap 711. The coupling means 718 can then be connected to a suitable tap of a tapping device T. To prevent the possible outflow of beverage from the container already before the coupling means are connected to the tapping device T, a closing device is provided. This closing device may be incorporated into the coupling means 18 or, optionally, in the hose 717, and be automatically released when the hose is connected or when the pressure in the container increases, yet a closing device is preferably incorporated adjacent or into the dispensing opening. This dispensing opening can for instance be designed as shown in FIG. 9A, which embodiment will be further described hereinbelow. When the cover part 722 is broken apart, the closing device can be reached, through the opening 720. This closing device can be pushed away downwards, while releasing a dispensing passage. In this position, the closing device 731 can be fixed, for instance through a slight rotation or through deformation. Also, a closing device can be used which is operated by removing the cover part 722. Many variations thereto are possible. Suitable closing devices are further known from the prior art. The hose 717 is suitably connected to a tap 730 of a tapping device, for which purpose the coupling means 718 are for instance designed as quick-action means capable of cooperating with quick-action means of the tap 730.

As pressure source, different types of gases or liquids may be used. For instance, gas may be fed under pressure from a container or pressure line network, or a gas or liquid may be fed by means of a pump 729, as shown in FIG. 9.

By feeding a pressure medium into the pressure chamber 709, the membrane 708 is displaced at least partially in the direction of the dispensing opening 707, thereby reducing the volume of the storage compartment 710. As a result, the beverage in the storage compartment 710 is pressurized. Accordingly, when the closing device 731 is opened, beverage is forced from the container 701 into the dispensing hose 717. Next, by opening the tap, the beverage can be tapped from the container. The beverage in the storage compartment 710 can be maintained at the required pressure by feeding the pressure medium into the pressure chamber, while the membrane 708 is displaced further. In this manner, the entire storage compartment 710 can be emptied through pressure by the membrane, until the membrane 708 abuts against the inside of the top portion of the wall 703 and the shoulder part 705, covering the dispensing opening 707 (FIG. 10). In this condition, the volume of the pressure chamber 709 is maximal and the volume of the storage compartment 710 is minimal.

Since the pressure in the storage compartment 710 is built up through displacement of the membrane 708 by means of a pressure medium in the pressure chamber 709, the pressure medium is prevented from contacting the beverage to be dispensed. Accordingly, the beverage is prevented from being affected by the pressure medium. In particular in the case of carbonated or otherwise gaseous beverages, this is of importance when a gas is used as pressure medium, for instance in the case of beer. After all, the quantity of carbon dioxide in the beer is not influenced by the pressure medium. Moreover, no dilution occurs if a liquid is used as pressure medium, in particular water.

If so desired, when the storage compartment 710 is thus emptied completely (FIG. 10), the pressure chamber can be emptied again, for instance by reversing the pump direction. This is advantageous in particular when a pressure liquid is used, because of the weight of such pressure medium. This will permit the membrane to be brought into its starting position again. Moreover, this enables the same pressure medium to be reused for a next container.

The membrane 708 is preferably attached to the wall at a distance A from the shoulder part 705 which is slightly larger than the distance B between the edge of the membrane 708 and the bottom 704. In the position shown in FIG. 10, where the storage compartment 710 is almost empty, the membrane 708 is preferably slightly elastically expanded. It is thus guaranteed that in that position, the membrane will be stretched completely, whereby inclusions of beverage between the membrane 708 and the inside of the storage compartment 710 are prevented.

The membrane may be manufactured from a substantially flat disk of rubber or plastic or like material, with a constant section. In an advantageous manner, the membrane may have a thickness which slightly increases towards the inside, so that during the tensioning of the membrane, deformations will extend inwards from the outside. Thus, the possible occurrence of beverage inclusions is prevented even more effectively. Further, for instance ridges and/or grooves 732 may be provided on the membrane, such as radial grooves shown in FIG. 13. These ridges and/or grooves 732 prevent the membrane from sticking to the wall of the container and also prevent beverage inclusions.

FIG. 12 shows an alternative embodiment of a device according to the invention, with the container 701 being completely included in a tapping device T. To that end, the tapping device T comprises a box-shaped receiving part 740 and a cover 741 which is for instance pivotally connected to the receiving part 740 and can be clamped thereon by means of clamping means 742. The receiving part 740 has a cylindrical inner space whose diameter approximately corresponds to the part of the container 701 which extends below the cap 711. Along the top edge, the receiving part 740 is provided with a first annular receiving groove 742, which is located on the inside and has a shape corresponding to the shape of the free longitudinal edge 743 of the apron 712 of the cap 711. This free longitudinal edge 743 is convex on the outside as a result of the groove 714 on the inside. When the container 701 is accommodated in the receiving part 740, the convexity 744 is in an at least liquid-tight sealing relationship with the first receiving groove 742. The cover 741 has an inside shape which offers at least sufficient space for accommodating the cap 711 and is provided, along the side thereof facing the receiving part during use, with a second annular receiving groove 745 which can fittingly connect to the top side of the convexity 744 of the cap 711. In this manner, a container 701 can be accommodated in the tapping device T with a proper fit, while between the part of the container 701 extending below the cap 711 and the surrounding receiving part 740, a closed-off space is formed.

Provided adjacent the bottom side of the receiving part 740 is a pressure medium supply line 747, opening into the space between the container 701 and the receiving part 740, preferably adjacent the connecting opening 706 of the container 701. When the pressure medium is introduced, it is fed into the pressure chamber 709, while an outwardly directed pressure is exerted on the container wall 703. Because this portion is enclosed by the receiving part 740, this may be of a relatively thin design. As it is, the receiving part 740 will provide the wall 703 with sufficient support during use to prevent damage. In the cover 741, an opening 746 is provided through which, prior to or possibly after the closing of the cover 741, the dispensing hose 717 can be passed, such that the coupling means 716 can be reached from the outside. In the embodiment shown in FIG. 12, a tap 730 is provided on the cover 741, which tap is fitted with counter-coupling means 748 for the coupling means 716.

In the embodiment shown, the tap 730 is of the hose cock type. The tap 730 comprises a lever 748 which is connected, via a pivot 749, to an arm 750 extending from the cover 741. Extending obliquely from the pivot 749, on the side directed towards the cover 741, is a pressure arm 751 which is fixedly connected to the lever 748. Transverse to the longitudinal direction of the pressure arm 751 and the arm 750; a pressure roller 752 extends from the free end of the pressure arm 750. Hence, when the lever 748 is pivoted, the pressure roller 752 is moved relative to the arm 750. Provided at the free end of the arm 750 is a bent dispensing tube 753, comprising, at the end thereof which is mounted on the arm 750 and which is located on the side of the pivot 749 remote from the cover 741, the counter-coupling means 754. After the container 701 has been inserted into the tapping device T, the dispensing hose 717 is passed through the cover 741 and placed under the pressure roller 752 on the arm 750, while the coupling means 716 are coupled to the counter-coupling means 754. If the lever 748 is moved into an approximately vertical position, the hose 717 is pressed shut by the pressure roller 752; if the lever 748 is moved into an approximately horizontal position, the hose 717 is released and beverage can be forced from the container, via the hose 717 and the dispensing tube 753, for instance into a glass held underneath the dispensing tube. This tap is described as an example and is particularly inexpensive and simple in manufacture and use. Of course, all types of other taps, for instance of existing tapping devices, may be used as well. Pressure-measuring means may be provided which control the feed of the pressure medium into the pressure chamber on the basis of a preset, desired tapping pressure, depending on the pressure in, for instance, the dispensing hose 717 or the storage compartment 710.

The cap 711 preferably has a flat top side 719. This has the advantage that the container 1 can be positioned on the cap 711, so that the bottom side of the container need not necessarily be flat and, moreover, may be of such design that it can support the container at least in filled condition. Thus, the bottom side of the container may for instance be double-curved, which may be advantageous in terms of strength and deformation. Since the cap 711 covers the shoulder part 705, this shoulder part 705 may likewise have a random, non-flat shape, for instance double-curved. Moreover, a particularly recognizable outward appearance may thus be obtained.

However, in the case of relatively large containers, for instance barrels containing 10, 25 or 50 liters, the container is preferably constructed in such a manner that it can indeed be positioned on the bottom side. For such barrels, a free arrangement of the container 701 is usually preferred to confinement thereof in a tapping device as shown in FIG. 12. Moreover, for such relatively large barrels, a different type of cap is preferably used, which does not span the entire top side of the container. For such barrels, use can for instance be made of connections as are conventional for beer barrels, which, however, are known from practice with only a connecting line, while a bypass line may in fact also be provided for the feed line for the pressure medium from adjacent the top side of the barrel to the connection of the pressure chamber, enabling it to be used with existing tapping installations. Also, a cap can be used which for instance covers only the dispensing opening 707 and provides a tampering seal action in a known manner or is designed without tampering seal action. If required, the cap may also be omitted. Many variations hereto are possible.

FIG. 9A diagrammatically shows a detail of a closing device 731. This closing device 731 comprises a piston 760 having a cover plate 761 which, in the closing position, sealingly abuts against the dispensing opening 707 at the bottom side. From the cover plate 761, a rod 762 extends through the dispensing opening 707 into the space 716. The rod 762 has a slightly flat section with a shoulder 763 on either side thereof. Provided in the dispensing opening 707 are two grooves 764 capable of receiving the shoulder 763 such that the cover plate 761 covers the dispensing opening 707. The cover plate 761 is biased in this position by a spring 765. If the container is to be opened, the rod 762 is pressed down, in the direction of the bottom 704, and subsequently rotated so that the shoulders 763 are displaced relative to the grooves 764, into the position shown in FIG. 9A in broken lines. This creates an opening 766 along the cover plate 761, through which beverage can flow from the storage compartment 710 towards the dispensing hose 717. In this position, the piston 760 is released, while the shoulders 763 are pressed by the spring 765 against the shoulder part 705 next to the grooves 764. Because the closing device 731 is normally covered by the cap 711, there is no danger of the opening 66 being unintentionally released.

In an alternative embodiment, as shown in FIG. 9E, the cap 711 is connected to the container 701 via internal screw thread in a stub 767 extending from the top face 719 and external screw thread on a neck part 768 around the dispensing opening 707, the groove 713 being of such design that a slight vertical movement of the cap 711 relative to the container is possible, while the two screw threads cannot become detached from each other and always sealingly connect to each other. Adjacent the top side of the stub, the flexible hose 717 is connected to the inner space thereof. When the cap 701 has been screwed completely downwards, as shown on the left in FIG. 9B in broken lines, the connecting hose 717 is closed by the neck part 768. When the cap 711 is screwed upwards, until the groove 713 strikes the edge 714, as shown in FIG. 9B in full lines, the connecting hose 717, above the neck part 768, comes into open communication with the dispensing opening 707 and beverage can be dispensed. If required, a tear edge may be provided along the free bottom edge of the apron 712, which edge, when the cap 711 is being screwed upwards, tears loose and acts as further tampering seal means.

In the embodiments shown in the drawing, it is shown diagrammatically that the membrane 708 is secured against the inside of the container wall 703. To that end, the membrane may for instance be glued or fixed by means of a clamping ring or-the like. In an embodiment not shown, the container is built up of two halves, which can for instance be mounted on each other by means of a clamping connection, screw thread, glue or welding techniques. Between the two halves, a provision is made in which the membrane can be clamped. To that end, a clamping ring can for instance be attached to one of the halves of the container before the two container halves are coupled, to which clamping ring the membrane is attached. Such embodiment has the advantage that the membrane can readily be attached in a positionally fixed manner, while, moreover, the membrane remains accessible for inspection, repair and replacement, at least when the container halves are detachably coupled.

A container 701 according to the invention can be cleaned and filled in the usual manner. For cleaning, the container may be connected via the connecting opening to, for instance, a pressure source, for instance a water line, while to the dispensing opening, a flush line may be connected. The two components may be filled alternately, so that in each case, the opposite compartment is emptied through displacement of the membrane. Accordingly, foul is removed from the container and the membrane is flushed as well. Damages to the membrane can be readily detected on account of pressure loss occurring and the flowing together of the pressure medium and the flushing medium. Of course, filling the storage compartment with beverage can be effected via the dispensing opening.

FIG. 9C shows an alternative embodiment of a container according to the invention, in which the barrel-shaped container 701 is built up from a container body 702, while on the top edge of the cylindrical longitudinal wall 703, the shoulder part 705 is of cover-shaped design and fixed over this upper longitudinal edge, for instance by a known flanging operation. Between the cover-shaped shoulder part 705 and the longitudinal wall 703, the top wall of the membrane 708 is secured in the flanged edge. The membrane 708 may for instance be manufactured from a relatively thin foil and extend along the entire inner wall of the container body 702. Such embodiment is in particular suitable as a barrel that is to be used only once, although reuse is of course also possible. For manufacturing a barrel according to FIG. 9C, techniques such as deep- or thin-drawing, pressing and flanging, known per se, may be applied.

FIG. 14 shows an alternative embodiment of a container 801 according to the invention, wherein corresponding parts have corresponding reference numerals. The container 801 comprises a closed wall 803 and bottom 804, with a piston 808 extending within the wall 803, parallel to the bottom face 804, which piston has its longitudinal wall sealingly yet movably abutting against the inside of the longitudinal wall 803. This piston 808 separates the bottom compartment 809 from the superjacent storage compartment 810. Extending through the opening 806 in the bottom 804 of the container 801 is a screw spindle 830, which abuts by a first end against the bottom side of the piston 808, while the opposite, second end extends outside the container 801 and is rotatable in the direction of the arrow R by means of members suitable therefor, for instance an electric motor. Provided in the bottom 804 is a nut 831 capable of cooperating with the screw spindle 830. Upon a rotation of the screw spindle 830 within the nut 831, a vertical movement in the direction of the arrow P of the piston 808 is effected, as a result of which the compartment 809 is enlarged and the compartment 810 is reduced and vice versa. By its first end, the screw spindle 830 is connected to the piston such that the screw spindle can rotate about its longitudinal axis and relative to the piston 808, while the piston cannot move axially relative to the screw spindle 830. Thus, a direct coupling between the movements of the screw spindle 830 and the piston 808 is created.

FIG. 15 diagrammatically shows a further alternative embodiment of a device according to the invention, in particular suitable for use in, for instance, hotels, restaurants, bars, etc. having a relatively limited volume per time unit of beverage to be dispensed, which beverage is to be cooled. Corresponding parts have comparable reference numerals again, preceded by the numeral 9. In this embodiment, the coupling means 918 of the dispensing hose 917 are coupled to a so-called in-line cooler 980, for instance a through-flow heat exchanger 981 communicating with cooling means 982. On the side remote from the coupling means 918, a connecting line 983 connects to the in-line cooling means 980, which further connecting line 983 is connected to a tapping device 930 of, for instance, a type which is known from the hotel and catering industry. In the manner described hereinabove, a pressure source is connected, via a pump 929, to the pressure compartment of the container 901. Beverage to be dispensed from the container 901 is passed through the in-line cooler 980 and brought to or maintained at the proper temperature. By means of the in-line cooling means 980, the temperature of the beverage, in particular beer, can for instance be brought to or maintained at between 5 and 9° C., in particular to about 6–7° C., so that even in the case of an uncooled container and relatively long lines 917 and 983, the beverage can be dispensed at an optimal temperature. A strict regulation of the temperature of the beverage in, in particular, the lines 917 and 983 is of particular importance from a hygienic viewpoint. If the container 901 is disposed in a cooler at a relatively high temperature, beverage can nevertheless be dispensed directly and at the proper temperature by a device according to FIG. 15, while after the passage of time, when the beverage in the container 901 has been brought to the proper temperature, the in-line cooling means 980 can be switched off or, if necessary, be kept in use, which is in particular advantageous when the dispensing lines 917, 983 are relatively long. Of course, more or different in-line cooling means 980 can be used as well. The in-line cooling means 980 may be of such design that the beverage to be dispensed directly contacts fixed parts of the cooling means 980, but may also be of such design that for instance the dispensing hose 917 extends therethrough and indirect heat exchange is effected. The cooling efficiency of such last embodiment will be slightly less, yet in terms of hygiene, advantages are achieved thereby.

Because the use of a device according to the invention involves a separation between the beverage to be dispensed, in particular beer, and the pressure medium, it is possible to use, without a complicated control for the pressure in the container and the flow rate of the beverage during dispensing, the combination of a cooler in which the container is placed and an in-line cooler. As long as the pressure in the pressure chamber is kept higher than the equilibrium pressure in the beer in the entire temperature range for the beverage in the container (for instance between 5 and 30° C.) and kept constant, the in-line cooler 980 can readily be designed so that a constant flow rate of the beverage is obtained independently of the packing temperature. A control of the flow rate by the design of the cooling spiral of the in-line cooler 980 offers the advantage that added resistors for the beverage in the line or tap can be omitted. Such resistors are difficult to clean and hence form a source of infections for the beverage.

Because the connection for the beverage to the tapping device is a one-way connection, harmful bacteria or air can easily be prevented from entering the beverage in the package via this way, unlike conventional connections where a two-way connection is used, whereby bacteria and air are pumped directly from the tapping head into the package when the tapping head is being connected. As the entire device is cooled, any bacteria which may be present in the line will grow slowly, if at all. As a result, the storage life of the package can be increased to for instance 3–6 weeks, while, moreover, the tapping device needs to be cleaned less often, for instance 2–4 times per year. The known $CO_2$-bottles are no longer needed for a device according to the invention, although $CO_2$ can of course be used as pressure medium, although this is not preferred.

FIG. 16 shows a further alternative embodiment of a device according to the invention, comprising a container 901 receivable in a box-shaped receiving part 940 of a tapping device T, for instance as shown in FIG. 12. The receiving part 940 is indicated only diagrammatically. The container 901 comprises a bottom 904, a vertical cylindrical longitudinal wall 903 and a shoulder part 905 which, in the embodiment shown, is flanged on the longitudinal wall 903 and comprises the dispensing opening 907. In a vertical part 905*a* of the shoulder part 905, a number of connecting openings 906 are provided in the circumference, for connecting to the pressure source 929 via a connecting line 926. For this connection, an annular, preferably flexible ring 990 is provided in the receiving part 940. The ring 990 has two inwardly extending, finger-shaped edges 991, inclined towards each other, wherein between a chamber 992 is defined. The chamber 992 connects to the connecting line 926. During use, the edges 991 above and below the connecting openings 906 abut against the vertical part 905*a* of the shoulder part 205, while the edges 991 are elastically deformed to obtain an airtight sealing against the shoulder part 905. During use, the advantage thereby achieved is that by increasing the pressure in the chamber 992, the edges 991 are firmly pressed against the shoulder part 905*a*, to obtain an even better sealing. As the connecting openings 906 are located adjacent the top end of the container 901, the container may have any length as long as it fits within the receiving part 940, without the height of the connecting opening 907 changing thereby. This offers the advantage that in the same device, containers having a relatively small content (for instance 1.5 liters) as well as containers having a relatively large content (for instance 5 liters or more) can be accommodated. In fact, devices according to the present invention are also particularly suitable for use with containers having a large content (for instance 10, 25 or 50 liters), which are particularly suitable for uses in hotels, restaurants, cafes, etc.

In the embodiment shown in FIG. 16, the storage compartment 910 is formed by a relatively flexible, foil-shaped bag or compressible plastic bottle 908, suspended in, or at least attached adjacent the dispensing opening 907. When the pressure medium is introduced via the feed line 926 and the connecting openings 906, the bag 908 is compressed during use, while displacing the beverage from the storage compartment 910, whereby the pressure space is enlarged. The bag 908 may be connected to the cylindrical longitudinal wall 903 at a number of locations, distributed over its circumference, in such a manner that the bag will be compressed substantially in radial direction, thus ensuring even better that the entire storage compartment 210 will be emptied. Although in the embodiment shown, the beverage container is composed of two parts, it can of course also be of a one-part construction, to obtain for instance a bottle-shaped or barrel-shaped container 901 in which the storage compartment 910 is of a bag-shaped or bottle-shaped construction.

The positioning of the connecting openings 906 adjacent the top end of the container, at least spaced from the bottom 904 in the longitudinal wall 903 or the shoulder part 905, can of course also be applied to the exemplary embodiments having a membrane 8 which are shown hereinabove, as long as the connecting openings 706, 906 of course open on the side of the membrane 708 or the bag 908 that faces the pressure side. Moreover, a bag 908 can also be used in embodiments where the connecting opening 906 is located in the bottom part.

In the embodiment shown in FIG. 16, the container 901 can be confined in the receiving part 940 by means of the shoulders 914, comparable with the embodiment as shown in FIG. 12, while other manners of attachment may moreover be obtained, for instance engagement with the cylindrical wall. Combinations of embodiments according to the invention are understood to fall within the framework of the invention.

It will be appreciated that in a device according to FIG. 15, various different container 701, 801, 901, pressure sources, cooling means and the like can be used, in particular as described hereinabove.

In a device and assembly according to the invention, the container can be reused by collecting and refilling, while the dispensing means can, after use, be disposed of entirely or partially. This is in particular of importance from a hygienic viewpoint. However, it is also possible to reuse the dispensing means, after use, at least partially, after a thorough cleaning thereof. This is advantageous from an environmental viewpoint.

In the embodiment shown in FIG. 16, the beverage in the container is entirely enclosed by the bag 908. The advantage thus achieved is that the bag can be of a substantially oxygen-impermeable construction, so that the wall of the container may be made from a relatively oxygen-permeable plastic, if necessary. Such embodiment may be economically advantageous, because of the use of relatively inexpensive material.

Moreover; it is possible to design the bag so as to be double-walled, with the at least one connecting opening 906 being located between the inner and outer bags then present, in the pressure space 911 formed therein between. As a result, during use, the pressure of the pressure medium will substantially be borne by the outer bag, so that the wall of the container may be of a relatively thin and flexible design and which involves a relatively great freedom of design as regards the shape of the container. FIGS. 16A–C diagrammatically show three possible embodiments of such double-walled foil bag.

FIG. 16A shows a for instance blown inner foil bag 908*a* surrounded by an outer foil bag 908*b*. One or the two foil bags 908*a,b* may in fact be of multilayered construction, depending on the desired barrier properties thereof. The pressure space 911 is formed between the inner bag 908*a* and the outer bag 908*b*, around the inner bag 908*a*.

FIG. 16B shows an embodiment wherein the bag 908 is formed from three layers 908*c*, 908*d* and 908*e*, interconnected to form two compartments 910 and 911. When a pressure medium is fed between the first layer 908*c* and the second layer 908*d*, the volume of the pressure space 911 will increase while the beverage is forced from the storage compartment 910. In fact, for instance the second layer 908*d* and the third layer 908*e* may form part of a tubular foil profile against which the first layer 908*c* is sealed. Adjacent the bottom side, the three layers are interconnected and may moreover be attached to the container wall or bottom, as a result of which the bag 908 is included in the container in a positionally fixed manner.

In the embodiment shown in FIG. 16C, the foil bag 908 is built up from four foil layers 908*f–i*. For this purpose, for instance two foil-shaped tube profiles may be arranged one over the other and sealed adjacent the bottom side, while adjacent the top side, the wall of the outer foil layers 908*f* and 908*i* are sealed against the outer side of the inner foil layers 908*g* and 908*h*. Such a foil bag may also be composed of four sealed foil layers. Formed between the foil layers 908*g* and 908*h* is the storage compartment 910, around which the pressure space 911 is enclosed within the foil layers 908*f* and 908*i*. The feed of the pressure medium into the pressure space 911 will provide compression of the storage compartment 910, while displacing the beverage included therein. The bag 908 may again be secured to the bottom and/or the longitudinal wall to prevent movement of the bag relative to the container 901. The foil layers may again be of multilayered design, for reasons mentioned above.

In particular the embodiments shown in FIGS. 16*b* and 16*c* offer the possibility of filling the bag-shaped containers in a continuous process. To that end, a tube profile having a relatively great length relative to the length of the bag may be filled and, at suitable locations, constricted, sealed and cut loose to form a bag which is in each case filled with the desired beverage. This moreover readily prevents air from being included in the bag. In fact, other manners of filling are of course also possible.

The invention is by no means limited to the embodiments shown in the Figures and described. Many variations thereto are possible.

A beverage container according to the invention may for instance be provided with a slightly inwardly extending neck part, which limits the overall height of the beverage container. Further, a beverage container may be used which is provided with a filling opening at a distance from the dispensing opening, for instance adjacent the bottom side of the beverage container. This enables the beverage container to be assembled already before the filling operation, while the tampering seal membrane may be formed integrally with the beverage container. In the wall of the beverage container, deformation zones may be incorporated, for instance facet-shaped, annular or strip-shaped faces which, during use, provide that the beverage container has a preferred direction for compressing under the influence of pressure built up in the pressure chamber. It may thus be effected that the beverage container is compressed in a preferred direction. Further, for instance different parts may be integrated, such as the primary and secondary caps or the first coupling part, the connecting part and the second coupling part. Although only a tapping device for accommodating one beverage container is shown, embodiments wherein two or more beverage containers are accommodated in the same tapping device, preferably side by side in one or more pressure chambers, are possible as well. In that case, the degree to which each beverage container is emptied will be determined during use by the pressure in the or each pressure chamber and the degree to which beverage is taken from each of the containers.

Of course, in addition to or instead of a pressure medium, mechanical pressure means may be used for at least supporting the compression of the beverage container or the displacement of a membrane in a membrane barrel. When an undeformable barred as described is used, the membrane may be of a bag-shaped design and attached to the beverage container, or at least adjacent the neck part thereof.

The container 1 may have a different shape, for instance a polygonal section and a convex end, while the cap 11, if any, may moreover have various other shapes. The cap may moreover be secured to the container in various suitable manners. The container may be connectable to a pressure source in another manner, while the pressure source may be designed in any suitable manner. The membrane may be of such elastic design, that in slack condition it extends at a distance from the wall of the container, for instance flat. Moreover, the membrane may be arranged in any desired position, as long as it separates the pressure chamber from the storage compartment. The connecting means for the pressure source and the connecting means for the dispensing means may be arranged in other manners and in different positions, for instance both adjacent the top side of the container, with a channel being provided for feed-through of the pressure medium to the pressure chamber. Such channel may for instance be provided in a receiving part as described. In the specification, beer is mentioned as beverage to be dispensed. It will be understood that all kinds of other beverages may be included in the container as well, such as soft drinks and other alcoholic beverages. Also, different beverages may be provided in for instance juxtaposed storage compartments in one container.

These and many comparable variations are understood to fall within the framework of the invention.

What is claimed is:

1. An assembly for dispensing a fluid, said assembly comprising a tapping device (1) and a fluid container (3), wherein said tapping device has a closable lid and said fluid container has a storage compartment therein for said fluid, said fluid container being inserted within said tapping device, the assembly further comprising dispensing means (95,92,95) attached to said fluid container at an upper portion thereof, and a pressure chamber disposed within said tapping device, wherein said upper portion of said fluid container extends at least partially outside said tapping device, such that said lid of said tapping device, when in a closed position thereof substantially simultaneously:

a) brings said dispensing means into fluid communication with said fluid storage compartment of said fluid container; and b) brings said pressure chamber into fluid communication with a pressure source to enable pressurization of said pressure chamber, wherein said storage compartment and said dispensing means are brought into fluid communication, and said pressure chamber is enabled for pressurization, only when said lid is in said closed position, pressure means being provided for feeding a pressure medium into the pressure chamber to compress said fluid storage compartment, thereby forcing said fluid, via the dispensing means, from the fluid container (3) without the pressure medium contacting the fluid, a dispensing opening (43) being located outside the tapping device (1) during use.

2. An assembly according to claim 1, characterized in that the closing part (65, 15) comprises a collar-shaped part (67) surrounding the dispensing opening (43) and spaced a distance radially therefrom, said collar-shaped part (67) sealingly engaging closing means (13) of said tapping device when said lid of said tapping device (1) is in said closed position.

3. An assembly according to claim 1, characterized in that the fluid container (3) is bottle-shaped or barrel-shaped, comprising a shoulder part (39) having the dispensing opening (43), the closing part (15) extending adjacent the circumferential edge of the shoulder part (39) which edge is remote from the dispensing opening (43).

4. An assembly according to claim 1, characterized in that the closing part (15) is fixedly connected to and integrally manufactured with the fluid container (3).

5. An assembly according to claim 1, further comprising a fit-on part (65) mounted on the fluid container (3) on a neck portion (41) thereof, said fit-on part (65) surrounding said dispensing opening, characterized in that the closing part (15) is accommodated within said fit-on part.

6. An assembly according to claim 5, characterized in that, the fluid container is deformable by the pressure built up during use in the pressure chamber, said closing part (15) and said fit-on part (65) being substantially undeformable thereby maintaining a seal therebetween during use.

7. An assembly according to claim 6, characterized in that the fluid container within the fit-on part is deformable.

8. An assembly according to claim 6, wherein said fluid container is substantially entirely compressible.

9. An assembly according to claim 1, characterized in that the fluid container (3) is substantially undeformable by pressure build-up in the pressure chamber (11) during use, wherein said pressure chamber (11) is in fluid communication with a pressure compartment within the fluid container (3), and wherein the fluid container (3) comprises a deformable part separating a storage compartment for the fluid to be dispensed from said pressure compartment.

10. An assembly according to claim 9, characterized in that the deformable part is a membrane (444, 544, 708).

11. An assembly according to claim 9, characterized in that the deformable part is a flexible bag (35, 37, 235, 437, 544, 635, 908), having a collar part at an opening thereof, said collar part being connected to the interior wall of the fluid container (3), in fluid communication with the dispensing opening (43).

12. An assembly according to claim 9, wherein said fluid container (3) has a pressure opening in a wall therein, said pressure opening connecting the pressure compartment in the fluid container to the environment.

13. An assembly according to claim 12, having at least one pressure opening adjacent a shoulder part (39) of the fluid container (3).

14. An assembly according to claim 1, characterized in that the fluid container is thin-walled, self-supporting and manufactured from plastic.

15. An assembly according to claim 14, wherein the fluid container is made from a thermoplastic polymer selected from the group consisting of PEN, PET and alloys thereof.

16. An assembly according to claim 1, characterized in that the fluid container (3) comprises a tubular dispensing means fixedly connected to said fluid container adjacent the dispensing opening.

17. An assembly according to claim 16, characterized in that the tubular dispensing means is partially flexible and hose-shaped, such that said tubular dispensing means can be elastically pressed shut in a relatively easy manner.

18. An assembly according to claim 16, the tubular dispensing means having a free end which, during use, extends outside the tapping device, said dispensing means coupled to a clamping mechanism whereby the passage in the dispensing means can be opened or closed by said clamping mechanism, wherein the dispensing means can be removed from the clamping mechanism and discarded together with the fluid container after use.

19. An assembly according to claim 16, characterized in that the tubular dispensing means has an engaging means attached thereto effective to aid positioning the free end of said tubular dispensing means in a tap.

20. An assembly according to claim 1, characterized in that in filled condition, prior to use, the fluid container comprises pierceable tampering seal means adjacent the dispensing opening, and piercing means for piercing the tampering seal means as a result of pressure build-up in the pressure chamber, said piercing means thereby bringing the inside space of the fluid container into communication with a dispensing channel for the fluid.

21. An assembly according to claim 20, characterized in that the fluid container (3) comprises a tubular dispensing means fixedly connected to said fluid container adjacent the dispensing opening, the tubular dispensing means comprising the piercing means and the dispensing channel.

22. An assembly according to claim 1, wherein in an unpressurized condition, the closing part (15) of the fluid container (3) is adjacent to and slightly spaced from the closing means (13) of the tapping device, said fluid container being forced upward under pressure buildup in the pressure chamber, thereby forcing closing part (15) against said closing means (13) to seal the pressure chamber.

23. An assembly according to claim 22, characterized in that in filled condition, prior to use, the fluid container comprises pierceable tampering seal means adjacent the dispensing opening, and piercing means for piercing the tampering seal means, wherein said piercing means are forced through the tampering seal means via said upward movement of the fluid container, thereby bringing the inside space of the fluid container into communication with a dispensing channel for the fluid.

24. An assembly according to claim 1, characterized in that the tapping device comprises a barrel-shaped first part having a cover part pivotally mounted thereon, the fluid container being positionable vertically within said first part, the pressure chamber being defined within the annular space between an inner wall of said first part of said tapping device and the outer wall of said fluid container, said cover part being closable over the fluid container and protection means being provided to prevent the cover part from being opened when the pressure chamber is in a pressurized condition, the fluid container remaining closed to the environment until the pressure chamber is first pressurized.

25. An apparatus according to claim 1, wherein the pressure chamber is at least partially defined and closed to the environment by a closing part (15) of the fluid container (3), said closing part (15) being spaced a distance from a dispensing opening (43) of the fluid container (3), said fluid container (3) being bottle-shaped or barrel-shaped, comprising a shoulder part (39) in which the dispensing opening (43) is disposed, the closing part (15) extending adjacent the circumferential edge of the shoulder part (39), which edge is remote from the dispensing opening (43), whereby closing part (15) is fixedly connected to and integrally manufactured with the fluid container (3).

26. An apparatus according to claim 25, characterized in that the fluid container is manufactured from synthetic material said fluid container adapted to store beer having a $CO_2$-content of more than 3 g/kg, the fluid container having a volume of at least 2 liters.

27. An assembly according to claim 26, wherein said fluid container is made from a thermoplastic polymer selected from the group consisting of PEN, PET and alloys thereof.

28. An apparatus according to claim 25, characterized in that deformation zones are provided in the wall of the fluid container to cause at least a portion of the fluid container to be compressed in radial or axial direction under the influence of external pressure.

29. An apparatus according to claim 25, characterized in that the fluid container has a substantially non-deformable outer wall and a flexible bag within said outer wall defining a storage compartment therein, said flexible bag and said outer wall defining a pressure compartment therebetween, said flexible bag having an opening which is secured adjacent the dispensing opening of the fluid container, said flexible bag being substantially oxygen-impermeable.

30. An assembly according to claim 25, said fluid container further comprising a valve, said valve being actuated by said lid of said tapping device when in said closed position to bring said dispensing means into fluid communication with the interior space of said fluid container.

31. An assembly according to claim 1, said fluid container further comprising a valve, said valve being actuated by said lid of said tapping device when in said closed position to bring said dispensing means into fluid communication with the interior space of said fluid container.

32. An assembly according to claim 1, wherein said pressure chamber is part of said tapping device, said fluid container being inserted into said pressure chamber within said tapping device.

33. An assembly according to claim 1, wherein said container, the upper part being shaped for leading pressure exerted on said fluid container by said lid in a closed position to the tapping device, said upper part having a valve, said valve being actuated by said lid of said tapping device when brought into said closed position thereof to bring said dispensing means into fluid communication with said fluid in said fluid container for dispensation thereof, and said lid substantially simultaneously enabling delivery of said pressure medium to said container only when in said closed position thereof.

34. A method for tapping a beverage, wherein:

the beverage in a closed fluid container is placed in a box shaped part of a tapping device with a lid, the fluid container is provided with a fluid storage compartment therein, a dispensing opening and a closing part which surrounds the dispensing opening at a distance therefrom and which is laid sealingly against the box-shaped part to form a pressure chamber when said lid is in a closed position, at least between the fluid container, the inner wall of the box-shaped part and the closing part, a free end of an at least partially relatively flexible, tubular dispensing means, connected to the fluid container adjacent the dispensing opening, is moved to a position outside the tapping device, whereupon a lid of said tapping device is closed over the fluid container and secured in a closed position, such that said lid of said tapping device, when in said closed position substantially simultaneously:

a) brings said dispensing means into fluid communication with said fluid storage compartment of said fluid container; and b) brings said pressure chamber into fluid communication with a pressure source to enable pressurization of said pressure chamber, wherein said beverage and said tubular dispensing means are brought into fluid communication, and said pressure chamber is enabled for pressurization, only when said lid is in said closed position, the part of the tubular dispensing means extending outside the tapping device is placed in a clamping device whereby the passage in the dispensing means can be opened and closed as desired, the pressure in the pressure chamber is increased by means of pressure means, whereupon the interior of the fluid container is brought into free communication with the environment, at least by means of the clamping device, at least a part of the beverage is discharged through the tubular dispensing means to the environment by reducing at least the beverage-containing part of the fluid container under the influence of the pressure buildup.

35. A method according to claim 34, characterized in that during or prior to the interior of the fluid container being brought into open communication with the environment, antiseptically sealing tampering seal means are pierced by piercing means under the influence of the pressure buildup in the pressure chamber.

36. A method according to claim 35, characterized in that during pressure buildup in the chamber, the fluid container is moved relative to the piercing means, such that the piercing means are forced through the tampering seal means.

37. A method according to claim 34, characterized in that as container, a compressible container is used, the closing part being provided on a fit-on part which is relatively rigid compared with the container, the container, during the pressure buildup in the pressure chamber, being compressed in the fit-on part while dispensing the beverage.

38. A method according to claim 34, characterized in that said fluid container, is a relatively rigid container, comprising a storage compartment and at least a portion of the pressure chamber, separated by a flexible membrane means, wherein, by increasing the pressure in the pressure chamber, the membrane means is forced at least partially in the direction of the dispensing opening, while displacing the beverage from the decreasing storage compartment.

39. A tapping device comprising a pressure chamber (11) into which a fluid container (3) is inserted during use, and a lid which is closed over said fluid container (3) in a closed position during use, said fluid container (3) having a fluid storage compartment therein, wherein an upper portion of said fluid container extends at least partially outside said pressure chamber (11), such that the pressure chamber (11) is at least partly enclosed between the fluid container (3) and the tapping device, whereby the pressure chamber is at least partially defined and closed to the environment by a closing part (15) of said fluid container (3), surrounding the dispensing opening (43) and spaced radially therefrom, the dispensing opening (43) of the fluid container (3) being located outside the pressure chamber (11), and wherein said lid of said tapping device, when in said closed position substantially simultaneously:

a) brings a dispensing means into fluid communication with said fluid storage compartment of said fluid container; and b) brings said pressure chamber into fluid communication with a pressure source to enable pressurization of said pressure chamber, wherein said storage compartment and said dispensing means are brought into fluid communication, and said pressure chamber is enabled for pressurization, only when said lid is in said closed position.

40. An assembly for dispensing a fluid, said assembly comprising a tapping device (1) and a fluid container (3), wherein said tapping device has a closable lid and said fluid container has a storage compartment therein for said fluid, said fluid container being inserted within said tapping device, said assembly further comprising dispensing means (95, 92,95) attached to said fluid container at an upper portion thereof, and a pressure chamber disposed within said tapping device, wherein said upper portion of said fluid container extends at least partially outside said tapping device, such that said lid of said tapping device, when in a closed position thereof substantially simultaneously:

a) brings said dispensing means into fluid communication with said fluid storage compartment of said fluid container; and b) brings said pressure chamber into fluid communication with a pressure source to enable pressurization of said pressure chamber, wherein said storage compartment and said dispensing means are brought into fluid communication, and said pressure chamber is enabled for pressurization, only when said lid is in said closed position, pressure means being provided for feeding a pressure medium into the pressure chamber to compress said fluid storage compartment, thereby forcing said fluid, via the dispensing means, from the fluid container (3) without the pressure medium contacting the fluid, a dispensing opening (43) being located outside the tapping device (1) during use, wherein said fluid container (3) is bottle-shaped or barrel shaped, comprising a shoulder part (39) in which the dispensing opening (43) is disposed, the closing part (15) extending adjacent the circumferential edge of the shoulder part (39), which edge is remote from the dispensing opening (43), whereby the closing part (15) is fixedly connected to and integrally manufactured with the fluid container (3), said assembly further comprising a fit-on part (56), said fit-on part (56) being provided with means such that it can be mounted on said fluid container surrounding the dispensing opening (43), on a neck part (41) of said fluid container.

41. An assembly for storing and dispensing beer and other beverages, said assembly comprising a fluid container for the relevant beverage and dispensing means for the beverage, the fluid container comprising separating means separating a storage compartment from a pressure compartment therein, the dispensing means being connectable to the storage compartment and a pressure source being connectable to the pressure compartment, the arrangement being such that, during use, a pressure medium can be introduced into the pressure compartment by means of a pressure source, so that, when the dispensing means are open, the beverage is driven from the storage compartment with at least partial displacement of the separating means causing reduction of the storage compartment volume, wherein said fluid container is inserted into a tapping device for dispensing said beverage, said fluid container being adapted such that said pressure medium can be introduced into said pressure compartment, and said dispensing means can be open, only when said fluid container is inserted into said tapping device, said tapping device being adapted to automatically and substantially simultaneously open said dispensing means and establish a pressure connection between said pressure compartment and said pressure source.

42. An assembly according to claim 41, characterized in that the pressure source and a tapping means for connection to the dispensing means form part of a tapping device, the tapping device comprising receiving means for receiving the fluid container therein, the fluid container being provided with at least one opening in a sidewall thereof spaced a distance above the bottom side thereof, to which the pressure source is connectable, thus providing fluid communication between the pressure source and the pressure compartment in the fluid container.

43. An assembly according to claim 41, characterized in that the storage compartment is enclosed by a relatively flexible bag mounted in, at least adjacent the dispensing opening of, the fluid container, the pressure compartment being enclosed between the wall of the fluid container and the bag.

44. An assembly according to claim 41, characterized in that the fluid container comprises a cap fixedly connected thereto, at least a portion of the dispensing means being enclosed by the cap, the cap having at least one opening which is closed by a cover part thereof, tampering seal means being provided in the cover part, such that the portion of said dispensing means enclosed by the cap is exposed to the outside of the fluid container only after breaking the tampering seal means.

45. An assembly according to claim 44, characterized in that the tampering seal means comprise a plurality of elements connecting the cover part to the cap.

46. An assembly according to claim 41, characterized in that the dispensing means comprise an at least partially flexible tube fixedly attached to the fluid container at one end thereof, and connectable to tapping means at a second end thereof.

47. An assembly according to claim 41, characterized in that cooling means are provided adjacent the dispensing means for cooling beverage during dispensing thereof.

48. An assembly according to claim 41, characterized in that engaging means are provided on the dispensing means, the engaging means comprising at least one face which, during use, is visible on the outside and on which advertising or identification information is provided.

49. A container for use in An assembly according to claim 41.

50. An assembly according to claim 41, wherein said pressure compartment of said fluid container is closed to the outside environment.

51. An assembly according to claim 41, said fluid container further comprising a valve, said valve being actuated by a lid of a tapping device when in a closed position thereof to bring said dispensing means into fluid communication with said storage compartment for dispensing said beverage.

52. An assembly for dispensing a fluid, said assembly comprising a tapping device (1), a fluid container (3), and dispensing means, wherein said tapping device has a closable lid and said fluid container has a storage compartment therein for said fluid, said tapping device having a chamber therein, in which chamber during use the fluid container is inserted, an upper portion of said fluid container extending at least partly outside said chamber, such that said lid of said tapping device, when in a closed position, cooperates with said extending upper portion of said fluid container to retain said container inside said tapping device, pressure means being provided for feeding a pressure medium into the container to compress said fluid, thereby forcing said fluid, via the dispensing means, from the fluid container without the pressure medium contacting the fluid, wherein, during use, the container is suspended in said chamber by said upper part, wherein upon closing said lid of said tapping device, said dispensing means are brought into fluid communication with said fluid inside of said fluid container, the upper part being shaped for leading pressure exerted on said fluid container by said lid in a closed position to the tapping device, said upper part hating a valve, said valve being actuated by said lid of said tapping device when brought into said closed position thereof to bring said dispensing means into fluid communication with said fluid in said fluid container for dispensation thereof, and said lid substantially simultaneously enabling delivery of said pressure medium to said container only when in said closed position thereof.

53. An assembly according to claim 52, wherein said upper portion of said fluid container is substantially dome shaped.

54. An assembly according to claim 52, wherein said upper portion carries a valve, said valve being actuated by said lid of said tapping device when brought into said closed position thereof to bring said dispensing means into fluid communication with said fluid in said fluid container for dispensing said fluid.

55. An assembly according to claim 52, wherein a series of fluid containers of differing sizes can be used therewith, wherein each of said containers has an upper portion compatible with said tapping device for suspending each of said containers in said tapping device during use.

* * * * *

UNITED STATES PATENT AND TRADEMARK OFFICE

CERTIFICATE OF CORRECTION

PATENT NO. : 6,375,048 B1
DATED : April 23, 2002
INVENTOR(S) : van der Meer et al.

It is certified that error appears in the above-identified patent and that said Letters Patent is hereby corrected as shown below:

Title page,
Item [57], ABSTRACT,
Please delete the paragraph in its entirety and insert the following paragraph:
-- Assembly of a tapping device and a container for fluid, in particular beer or soft drink, to be dispensed via the tapping device, dispensing means being provided for the fluid, a pressure chamber being provided in the tapping device, in which pressure chamber, during use, the container extends at least partially, pressure means being provided for feeding a pressure medium into the pressure chamber for pressing, via the dispensing means, the fluid from the container without the pressure medium contacting the fluid, the pressure space during use being at least partially defined and closed to the environment by a closing part of the container, at a distance from the dispensing opening of the container, and the dispensing opening of the container being located outside the pressure chamber. --.

Column 2,
Lines 37-39, please delete the paragraph beginning with "In a further advantageous embodiment".

Column 3,
Line 1, please delete "$CO_2$-permeability" and insert therefor -- $CO_2$- permeability --.
Lines 42-54, please delete the paragraph beginning with "Such engagement means offers the advantage".

Column 4,
Lines 11-18, please delete the paragraph beginning with "In such embodiment, when pressure is built up".
After line 57 and before the paragraph beginning with "Moreover, the invention relates to" please insert the following paragraph:
-- The invention further relates to a tapping device for use in an assembly or a method according to the invention. The invention moreover relates to the use of a container according to the invention in an assembly or method according to the invention. The invention further relates to a fit-on part for use in an assembly or a method or in a container or a tapping device according to the invention. --.

Column 8,
Line 23, after "device" please insert -- 1 --.

Column 14,
Line 4, please delete "Construction." and insert therefor -- construction. --
Line 63, please delete "B;" and insert therefor -- B, --.

UNITED STATES PATENT AND TRADEMARK OFFICE

CERTIFICATE OF CORRECTION

PATENT NO. : 6,375,048 B1
DATED : April 23, 2002
INVENTOR(S) : van der Meer et al.

It is certified that error appears in the above-identified patent and that said Letters Patent is hereby corrected as shown below:

Column 19,
Line 12, please delete "705" and insert therefor -- 705. --.
Line 12, please begin a new paragraph starting with "Between the bottom".

Column 24,
Line 10, please delete "9E," and insert therefor -- 9B, --.
Line 35, please delete "or-the" and insert therefor -- or the --.

Column 32,
Lines 57-67, please delete and insert the following:
-- 33. An assembly according to claim 1, wherein said pressure chamber is located within said fluid container, said pressure chamber being separated from said storage compartment by a deformable bag. --.

Signed and Sealed this

Twelfth Day of November, 2002

*Attest:*

*Attesting Officer*

JAMES E. ROGAN
*Director of the United States Patent and Trademark Office*